US011587492B2

(12) United States Patent
Li

(10) Patent No.: US 11,587,492 B2
(45) Date of Patent: Feb. 21, 2023

(54) FULL-PANEL DISPLAY FOR DISPLAY APPARATUS

(71) Applicant: BOE Technology Group Co., Ltd., Beijing (CN)

(72) Inventor: Zhenzhen Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 312 days.

(21) Appl. No.: 16/763,353

(22) PCT Filed: Jul. 31, 2019

(86) PCT No.: PCT/CN2019/098620
§ 371 (c)(1),
(2) Date: May 12, 2020

(87) PCT Pub. No.: WO2021/016926
PCT Pub. Date: Feb. 4, 2021

(65) Prior Publication Data
US 2021/0407369 A1 Dec. 30, 2021

(51) Int. Cl.
*G09G 3/20* (2006.01)

(52) U.S. Cl.
CPC ..... *G09G 3/2074* (2013.01); *G09G 3/2092* (2013.01); *G09G 2300/0426* (2013.01);
(Continued)

(58) Field of Classification Search
CPC ..... G09G 3/2092; G09G 3/2074; G09G 2300/0426; G09G 2320/0686;
(Continued)

(56) References Cited

U.S. PATENT DOCUMENTS

2016/0240154 A1 8/2016 Forutanpour et al.
2018/0165533 A1* 6/2018 Cho ..... G06F 3/0412
(Continued)

FOREIGN PATENT DOCUMENTS

CN 106960863 A 7/2017
CN 107564470 A 1/2018
(Continued)

OTHER PUBLICATIONS

English translation, for (CN208507679), inventor Tan Wenjing, assignee BOE Technology GroupCo LTD (Year: 2019).*
(Continued)

*Primary Examiner* — William Boddie
*Assistant Examiner* — Saifeldin E Elnafia
(74) *Attorney, Agent, or Firm* — Intellectual Valley Law, P.C.

(57) ABSTRACT

A full-panel display with hybrid regional subpixel layouts is provided. The full-panel includes a display panel having a first region with an array of first subpixels of respective a first color, a second color, and a third color, and a second region with an array of second subpixels of respective the first color, the second color, and the third color. The array of first subpixels and the array of second subpixels are collectively configured to achieve a higher transmission rate in the first region to an accessory installed therein while keep a luminance ratio between the first subpixels unchanged from that between the second subpixels. Optionally, a number density and/or a unit subpixel area of the first subpixels of at least one color is smaller in the first region than that in the second region.

17 Claims, 10 Drawing Sheets

(52) U.S. Cl.
CPC ..... *G09G 2300/0439* (2013.01); *G09G 2300/0443* (2013.01); *G09G 2300/0452* (2013.01); *G09G 2300/0456* (2013.01); *G09G 2310/0243* (2013.01); *G09G 2320/0686* (2013.01)

(58) Field of Classification Search
CPC ... G09G 2300/0456; G09G 2310/0243; G09G 2300/0452; G09G 2300/0443; G09G 2300/0439
See application file for complete search history.

(56) References Cited

U.S. PATENT DOCUMENTS

| | | | |
|---|---|---|---|
| 2020/0111401 | A1 | 4/2020 | Zhao et al. |
| 2020/0234634 | A1 | 7/2020 | Li |

FOREIGN PATENT DOCUMENTS

| | | | |
|---|---|---|---|
| CN | 107633802 | A | 1/2018 |
| CN | 107886850 | A | 4/2018 |
| CN | 108039148 | A | 5/2018 |
| CN | 108648679 | A | 10/2018 |
| CN | 108766347 | A | 11/2018 |
| CN | 108881531 | A | 11/2018 |
| CN | 208507679 | U | 2/2019 |
| JP | 2015215410 | A | 12/2015 |

OTHER PUBLICATIONS

English translation for CN208507679, Inventor Tan Wenjing and Assignee BOE Tech. (Year: 2019).*
International Search Report & Written Opinion dated Mar. 26, 2020, regarding PCT/CN2019/098620.
First Office Action in the Chinese Patent Application No. 201980001207.1, dated Jul. 28, 2022; English translation attached.

* cited by examiner

FULL-PANEL DISPLAY FOR DISPLAY APPARATUS

CROSS-REFERENCE TO RELATED APPLICATION

This application is a national stage application under 35 U.S.C. § 371 of International Application No. PCT/CN2019/098620, filed Jul. 31, 2019, the contents of which are incorporated by reference in the entirety.

TECHNICAL FIELD

The present invention relates to display technology, more particularly, to a full-panel display, a driving method, a display apparatus having the same, and a method for forming a full-panel display.

BACKGROUND

For many advanced display products, a development trend is to pursue higher ratio of actual display region over total front area of a display panel thereof. However, existing subpixel layout in the display panel has its limitation that hinders the development or causes various issues in the development of full-panel display.

SUMMARY

In an aspect, the present disclosure provides a full-panel display. The full-panel display includes a display panel with hybrid regional subpixel layouts having a first region and a second region. The full-panel display further includes a first pixel array arranged in the first region. A respective first pixel includes a first subpixel of a first color, a first subpixel of a second color, and a first subpixel of a third color. Additionally, the full-panel display includes a second pixel array arranged in the second region. A respective second pixel includes a second subpixel of the first color, a second subpixel of the second color, and a second subpixel of the third color. The first region has a higher transmission rate to an accessory installed therein and yet collectively keep a ratio of luminance between the first subpixels of any two of the first color, the second color, and the third color substantially same as that between the second subpixels of corresponding two of the first color, the second color, and the third color. A number density and/or a unit subpixel area of at least one of the first subpixel of the first color, the first subpixel of the second color, or the first subpixel of the third color is smaller than a number density and/or a unit subpixel area of at least one of the second subpixel of the first color, the second subpixel of the second color, or the second subpixel of the third color.

Optionally, the number density of at least a first one of the first subpixel of a first color, the first subpixel of a second color, or the first subpixel of a third color is smaller than a number density of at least a first one of the second subpixel of the first color, the second subpixel of the second color, or the second subpixel of the third color. The unit subpixel area of at least a second one of the first subpixel of the first color, the first subpixel of the second color, or the first subpixel of the third color is smaller than a unit subpixel area of at least a second one of the second subpixel of the first color, the second subpixel of the second color, and the second subpixel of the third color. The first one of the first subpixel of the first color, the first subpixel of the second color, and the first subpixel of the third color is different from the second one of the first subpixel of the first color, the first subpixel of the second color, and the first subpixel of the third color. The first one of the second subpixel of the first color, the second subpixel of the second color, and the second subpixel of the third color is different from the second one of the second subpixel of the first color, the second subpixel of the second color, and the second subpixel of the third color.

Optionally, the number density of the first subpixel of the second color is configured to be smaller than that of the second subpixel of the second color. The unit subpixel area of the first subpixel of the first color is configured to be smaller than that of the second subpixel of the first color. The unit subpixel area of the first subpixel of the third color is configured to be smaller than that of the second subpixel of the third color. The luminance ratio between the first subpixel of the first color and the first subpixel of the second color is substantially same as that between the second subpixel of the first color and the second subpixel of the second color. The luminance ratio between the first subpixel of the first color and the first subpixel of the third color is substantially same as that between the second subpixel of the first color and the second subpixel of the third color.

Optionally, the number density of the first subpixel of the first color in the first region is set to be a first divide factor multiplying the number density of the second subpixel of the first color in the second region, and a unit subpixel area of a respective one first subpixel of the first color is set to be a second divide factor multiplying a unit subpixel area of a respective one second subpixel of the first color.

Optionally, the number density of the first subpixel of the third color in the first region is set to be a third divide factor multiplying the number density of the second subpixel of the third color in the second region, and a unit subpixel area of a respective one first subpixel of the third color is set to be a fourth divide factor multiplying a unit subpixel area of a respective one second subpixel of the third color. A product of the third divide factor and the fourth divide factor is set to be equal to a product of the first divide factor and the second divide factor.

Optionally, the number density of the first subpixel of the second color in the first region is set to be a fifth divide factor multiplying the number density of the second subpixel of the second color in the second region, and a unit subpixel area of a respective one first subpixel of the second color is set to be a sixth divide factor multiplying a unit subpixel area of a respective one second subpixel of the second color. A product of the fifth divide factor and the sixth divide factor is set to be equal to a product of the first divide factor and the second divide factor.

Optionally, each of the first divide factor, the second divide factor, the third divide factor, the fourth divide factor, the fifth divide factor, and the sixth divide factor is selected from a number between 0 and 1.2.

Optionally, the first divide factor is in a range of 0.90 to 1.10, the second divide factor is in a range of 0.40 to 0.60, the third divide factor is 1, the fourth divide factor is in a range of 0.45 to 0.55, the fifth divide factor is in a range of 0.40 to 0.60, the sixth divide factor is in a range of 0.90 to 1.10.

Optionally, a ratio of a width of a respective one of the first subpixels of the first/third color to a width of the respective one of the second subpixels of the first/third color is in a range of 0.40 to 0.60, and a ratio of a length of the respective one of the first subpixels of the first/third color to a length of the respective one of the second subpixels of the first/third color is in a range of 0.90 to 1.10.

Optionally, a ratio of a width of a respective one of the first subpixels of the first/third color to a width of the respective one of the second subpixels of the first/third color is in a range of 0.90 to 1.10, and a ratio of a length of the respective one of the first subpixels of the first/third color to a length of the respective one of the second subpixels of the first/third color is in a range of 0.40 to 0.60.

Optionally, the first pixel array includes a number density ratio of x:y:z for respective first subpixels of the first color, the second color, and the third color in the first region along both a row direction and a column direction, wherein x is in a range of 0.90 to 1.10, y is in a range of 0.90 to 1.10, and z is in a range of 0.90 to 1.10.

Optionally, the second pixel array includes a number density ratio of m:n:k for respective second subpixels of the first color, the second color, and the third color in the second region along both a row direction and a column direction, wherein m is in a range of 0.90 to 1.10, n is in a range of 1.90 to 2.10, and k is in a range of 0.90 to 1.10.

Optionally, the full-panel display also includes a pair of transitional rows of subpixels at an interface between the first region and the second region. The pair of transitional row of subpixels includes a first row belonging to the first region with a substantially same repeated pattern as other rows in the first region and a second row belonging to the second region with a repeat pattern of one second subpixel of the second color, one second subpixel of third color, and one second subpixel of the first color and a number density for the second subpixel of the second color being lower than that in other rows in the second region.

Optionally, the first color is red color (R), the second color is green color (G), and the third color is blue color (B).

Optionally, the first pixel array comprises a real RGB diagonal arrangement per consecutive pair of odd-even rows. Each even row of subpixels is shifted in row direction by a distance of one and one half width of the first subpixel relative to each previous odd row of subpixels.

Optionally, the second pixel array includes a GGRB subpixel arrangement. Each odd row of subpixels comprises a repeat pattern of one second subpixels of red color, two second subpixels of green color in column direction, and one second subpixel of blue color. Each even row of subpixels is shifted in row direction by a distance of one and one half width of second subpixel relative to each previous odd row of subpixels.

Optionally, the number densities of respective second subpixels of red color, green color, and blue color in the second region includes a ratio of 1:2:1 along both a row direction and a column direction.

Optionally, the second pixel array includes a subpixel layout selected from one of a Pentile RGBG subpixel arrangement, a Strip RGBG subpixel arrangement, a Diamond RGBG subpixel arrangement in the second region.

Optionally, the accessory installed in the first region includes one or more selected from photosensor, fingerprint sensor, camera lens, earpiece, distance sensor, infrared sensor, acoustic sensor, indicator, button, and knob.

In another aspect, the present disclosure provides a display apparatus including a display panel with hybrid subpixel layouts in a first region and a second region respectively configured to form a full-panel display described herein. The display panel includes a first plurality of first array subpixels in the first region and a second plurality of second array of subpixels in the second region and is substantially free of color shift from the first region to the second region and has a higher transmission rate in the first region than that in the second region for at least one accessory installed in the first region.

In another aspect, the present disclosure provides a method of driving a full-panel display including a display panel with hybrid regional subpixel layouts. The display panel includes a first region and a second region. The full-panel display includes a first pixel array arranged in the first region. A respective first pixel includes at least a first subpixel of a first color, a first subpixel of a second color, and a first subpixel of a third color. The full-panel display includes a second pixel array arranged in the second region. A respective second pixel includes at least a second subpixel of the first color, a second subpixel of the second color, and a second subpixel of the third color. The first region has a higher transmission rate to an accessory installed therein and yet collectively keep a ratio of luminance between the first subpixels of any two of the first color, the second color, and the third color substantially same as that between the second subpixels of corresponding two of the first color, the second color, and the third color. A number density and/or a unit subpixel area of at least one of the first subpixel of the first color, the first subpixel of the second color, or the first subpixel of the third color is smaller than a number density and/or a unit subpixel area of at least one of the second subpixel of the first color, the second subpixel of the second color, or the second subpixel of the third color. The method includes deriving first virtual-driving signals of virtual subpixels of the first color, virtual subpixels of the second color, and virtual subpixels of the third color in the first region based on real grayscale data of the first subpixel of the first color, the first subpixel of the second color, and the first subpixel of the third color respectively loaded to first pixels in the first region. Additionally, the method includes deriving second virtual-driving signals of virtual subpixels of the first color, virtual subpixels of the second color, and virtual subpixels of the third color in the second region based on real grayscale data of the second subpixel of the first color, the second subpixel of the second color, and the second subpixel of the third color respectively loaded to second pixels in the second region. The method further includes generating adjusted first virtual-driving signals for virtual subpixels in the first region by applying a grayscale adjusting factor to the first virtual-driving signals. Furthermore, the method includes using the adjusted first virtual-driving signals to drive virtual subpixels in the first region to achieve an effective luminance of a unit area in the first region. Moreover, the method includes using the second virtual-driving signals to drive virtual subpixels in the second region to achieve an effective luminance of a unit area in the second region. The grayscale adjusting factor is applied to render an effective luminance of a unit area in the first region to be substantially equal to effective luminance of a unit area in the second region based on same values of real grayscale data of the respective color.

Optionally, the step of deriving first virtual-driving signals includes, for an array of virtual pixels arranged in RGBG subpixel arrangement in the first region, deriving a first virtual-driving signal of a first color for an i-th virtual pixel in the first region as an effective grayscale data of the first color based on an average of a luminance of a first subpixel of the first color of an i-th first pixel in the first region generated by the respective real grayscale data thereof and a luminance of a first subpixel of the first color of a neighboring (i−1)-th first pixel in the first region generated by the respective real grayscale data thereof. The step of deriving first virtual-driving signals also includes deriving a first virtual-driving signal of a second color for the i-th virtual pixel in the first region as an effective grayscale data of the second color substantially equal to the real grayscale data of the second color for the i-th first pixel in the first region. The step of deriving first virtual-driving signals also includes deriving a first virtual-driving signal of a third color for a neighboring (i+1)-th virtual pixel in the first region as an effective grayscale data of the third color based on an average of a luminance of a first subpixel of the third color of the i-th first pixel in the first region generated by the respective real grayscale data thereof and a luminance of a first subpixel of the third color of a neighboring (i+1)-th first pixel in the first region generated by the respective real grayscale data thereof. The step of deriving first virtual-driving signals also includes deriving a first virtual-driving signal of a second color for the neighboring (i+1)-th virtual pixel in the first region as an effective grayscale data of the second color substantially equal to the real grayscale data of the second color for the (i+1)-th first pixel in the first region.

Optionally, the step of deriving second virtual-driving signals includes, for an array of virtual pixels arranged in RGBG subpixel arrangement in the second region, deriving a second virtual-driving signal of a first color for an i-th virtual pixel in the second region as an effective grayscale data of the first color based on an average of a luminance of a second subpixel of the first color of an i-th second pixel in the second region generated by the respective real grayscale data thereof and a luminance of a second subpixel of the first color of a neighboring (i−1)-th second pixel in the second region generated by the respective real grayscale data thereof. The step of deriving second virtual-driving signals also includes deriving a second virtual-driving signal of a second color for the i-th virtual pixel in the second region as an effective grayscale data of the second color substantially equal to the real grayscale data of the second color for the i-th second pixel in the second region. The step of deriving second virtual-driving signals also includes deriving a second virtual-driving signal of a third color for a neighboring (i+1)-th virtual pixel in the second region as an effective grayscale data of the third color based on an average of a luminance of a second subpixel of the third color of the i-th second pixel in the second region generated by the respective real grayscale data thereof and a luminance of a second subpixel of the third color of a neighboring (i+1)-th second pixel in the second region generated by the respective real grayscale data thereof. The step of deriving second virtual-driving signals further includes deriving a second virtual-driving signal of a second color for the neighboring (i+1)-th virtual pixel in the second region as an effective grayscale data of the second color substantially equal to the real grayscale data of the second color for the (i+1)-th second pixel in the second region.

Optionally, the method further includes integrating the step of deriving a second virtual-driving signal for each virtual pixel in the second region into a first subpixel rendering processor in a driving chip. Additionally, the method includes integrating the step of deriving a first virtual-driving signal for each virtual pixel in the first region and the step of obtaining an adjusted first virtual-driving signal in the first region associated with the second region into a second subpixel rendering processor in the driving chip. The driving chip is configured to receive the real grayscale data for a respective subpixel of one respective color in the second region based on which the first subpixel rendering processor is used to perform a first rendering process and to receive the real grayscale data for a respective subpixel of one respective color in the first region based on which the second subpixel rendering processor is used to perform a second rendering process to produce uniform luminance in a respective one virtual pixel in full panel including both the first region and the second region.

In yet another aspect, the present disclosure provides a driving chip for driving a pixel arrangement structure having a plurality of subpixels. The plurality of subpixels includes a first pixel array arranged in a first region and a second pixel array arranged in a second region. A respective first pixel includes at least a first subpixel of a first color, a first subpixel of a second color, and a first subpixel of a third color. A respective second pixel includes at least a second subpixel of the first color, a second subpixel of the second color, and a second subpixel of the third color. The first region has a higher transmission rate to an accessory installed therein and yet collectively keep a ratio of luminance between the first subpixels of any two of the first color, the second color, and the third color substantially same as that between the second subpixels of corresponding two of the first color, the second color, and the third color. A number density or a unit subpixel area of at least one of the first subpixel of a first color, the first subpixel of a second color, and the first subpixel of a third color is smaller than a number density or a unit subpixel area of at least one of the second subpixel of the first color, the second subpixel of the second color, and the second subpixel of the third color. The driving chip includes a memory and one or more processors. The memory and the one or more processors are connected with each other. The memory stores computer-executable instructions for controlling the one or more processors to 1) derive first virtual-driving signals of virtual subpixels of the first color, virtual subpixels of the second color, and virtual subpixels of the third color in the first region based on real grayscale data of the first subpixel of the first color, the first subpixel of the second color, and the first subpixel of the third color respectively loaded to first pixels in the first region; 2) derive second virtual-driving signals of virtual subpixels of the first color, virtual subpixels of the second color, and virtual subpixels of the third color in the second region based on real grayscale data of the second subpixel of the first color, the second subpixel of the second color, and the second subpixel of the third color respectively loaded to second pixels in the second region; 3) generate adjusted first virtual-driving signals for virtual subpixels in the first region by applying a grayscale adjusting factor to the first virtual-driving signals; 4) use the adjusted first virtual-driving signals to drive virtual subpixels in the first region to achieve an effective luminance of a unit area in the first region; and 5) use the second virtual-driving signals to drive virtual subpixels in the second region to achieve an effective luminance of a unit area in the second region. The grayscale adjusting factor is applied to render an effective luminance of a unit area in the first region to be substantially equal to effective luminance of a unit area in the second region based on same values of real grayscale data of the respective color.

In still another aspect, the present disclosure provides a method of forming a full-panel display. The method includes setting a full panel to a first region and a second region. The method further includes laying a first pixel array in the first region. A respective first pixel includes at least a first subpixel of a first color, a first subpixel of a second color, and a first subpixel of a third color. The method also includes laying a second pixel array in the second region. A respective second pixel includes at least a second subpixel of the first color, a second subpixel of the second color, and a second subpixel of the third color. Additionally, the method includes configuring a number density or a unit subpixel area of at least one of the first subpixel of the first color, the first subpixel of the second color, and the first subpixel of the third color to be smaller than a number density or a unit subpixel area of at least one of the second subpixel of the first color, the second subpixel of the second color, and the second subpixel of the third color, thereby collectively making a luminance ratio between the first subpixel of the first color and the first subpixel of the second color or the first subpixel of the third color substantially same as that between the second subpixel of the first color and the second subpixel of the second color or the second subpixel of the third color. Furthermore, the method includes installing a sensing accessory in the first region with a higher transmission rate for sensing signals through the first pixel array.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Some display products, such as a smart phone, are preferred to install one or more sensing accessory devices that require accessibility through a front area of the display panel. If the display panel is intended to form a full-panel display, an optional solution is to install the accessory devices beneath at least a portion of a layer of imaging pixels that is configured to be transparent for a sensing signal to be passed to/from the sensing accessory devices with a higher transmission rate by reducing pixel density or unit pixel area. However, this may cause reduced pixel density affecting image resolution in the at least the portion of the display panel, or non-uniformity of luminance from region to region, or regional color shift from a normal region to a transparent region.

Accordingly, the present disclosure provides, inter alia, a full-panel display with hybrid regional subpixel layouts, a driving method for the full-panel display, and a display apparatus having the same, and a fabricating method thereof that substantially obviate one or more of the problems due to limitations and disadvantages of the related art.

Figure 1:
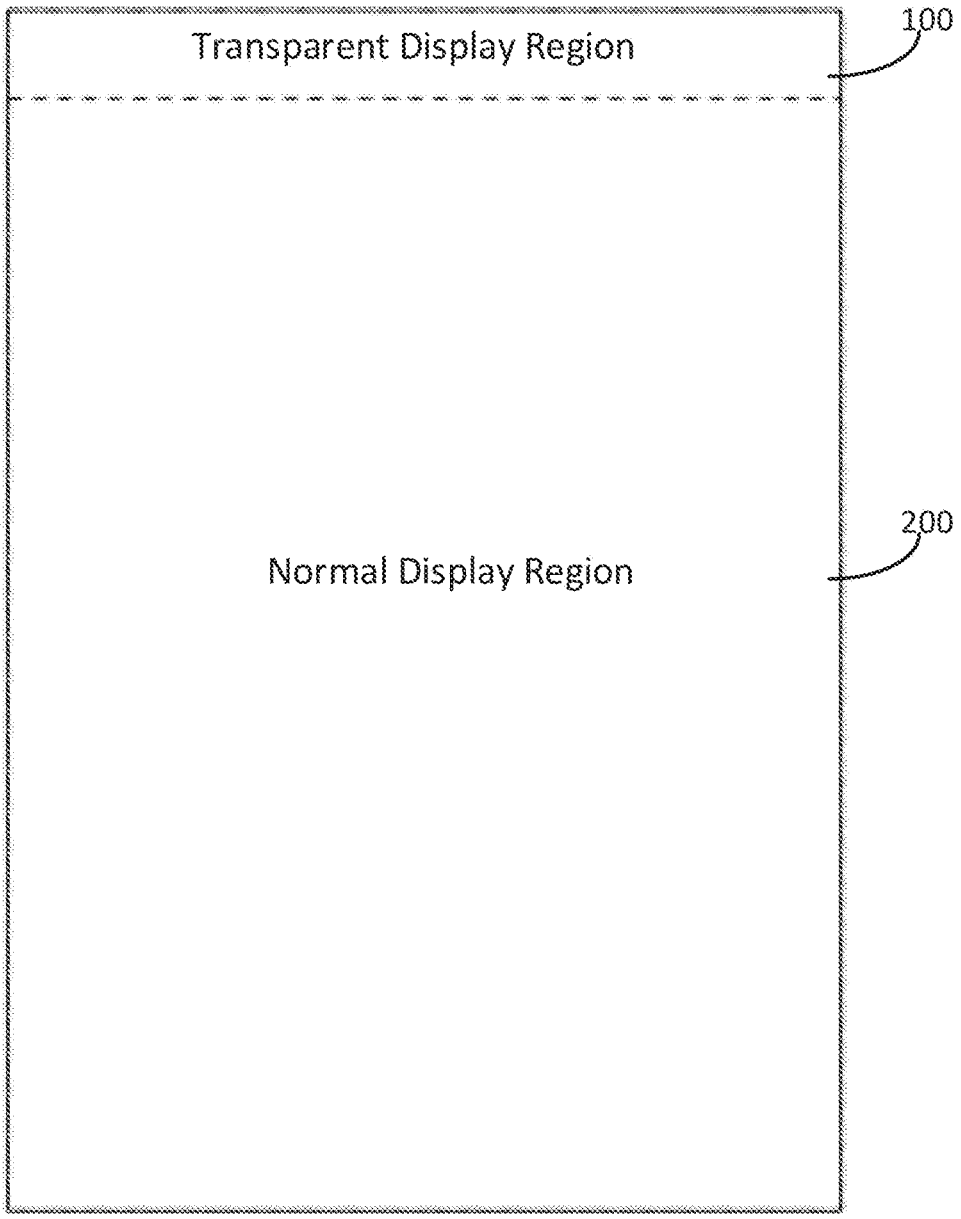
FIG. 1 is a schematic diagram of a display panel including a transparent display region and a normal display region with hybrid regional subpixel layouts for a full-panel display according to an embodiment of the present disclosure.

In one aspect, the present disclosure provides a full-panel display or a display panel designed for displaying image in a substantially full area thereof. Here, the full-panel display refers to a display panel of a rectangular shape that contains subpixels arranged from left edge to right edge and from bottom edge to top edge, or at least within 0.5 mm, 0.2 mm, or 0.1 mm, or smaller from the edges (provided with the frame thickness around edges is about 0.5 mm, 0.2 mm, or 0.1 mm or thinner. FIG. 1 shows a schematic diagram of a full-panel display according to an embodiment of the present disclosure. In the embodiment, the display panel has its full area divided into two regions: a first region 100 that is a transparent display region to accessory devices installed therein and a second region 200 that is a normal display region. Both the first region and the second region are arranged with a plurality of pixels in a certain subpixel distribution pattern with hybrid regional subpixel layouts across respective region's surface areas for displaying images in a full panel. Optionally, the first region and the second region are regions of a unitary display panel.

Optionally, the plurality of pixels in the first region 100 forms a first pixel array. A respective one pixel of the first pixel array includes at least a first subpixel of a first color, a first subpixel of a second color, and a first subpixel of a third color.

Optionally, the plurality of pixels in the second region 200 forms a second pixel array. A respective one pixel of the second pixel array includes at least a second subpixel of the first color, a second subpixel of the second color, and a second subpixel of the third color.

In an embodiment, the hybrid regional subpixel layout in the full-panel display is configured such that the first region 100 has a higher transmission rate to an accessory installed therein.

In a specific embodiment, the hybrid regional subpixel layout in the full-panel display is configured such that a number density and/or a unit subpixel area of at least one of the first subpixel of a first color, the first subpixel of a second color, or the first subpixel of a third color is smaller than a number density and/or a unit subpixel area of at least one of the second subpixel of the first color, the second subpixel of the second color, or the second subpixel of the third color. Optionally, the number density and/or the unit subpixel area of the first subpixel of the first color, or the second color, or the third color is set to be smaller than the number density and/or the unit subpixel area of the second subpixel of the corresponding first color, or the second color, or the third color. Optionally, the number density and/or the unit subpixel area of any two types of first subpixels (e.g., the first subpixel of the first color and the first subpixel of the second color, or the first subpixel of the first color and the first subpixel of the third color, or the first subpixel of the second color and the first subpixel of the third color) is set to be smaller than the number density and/or the unit subpixel area of the corresponding second subpixels of the corresponding two colors. Optionally, the number density and/or the unit subpixel area of the first subpixel of any color is set to be smaller than the number density and/or the unit subpixel area of the corresponding second subpixel of the corresponding color. As used herein, the term "number density" in the context of the present disclosure refers to the number of subpixels per unit area, e.g., the number of subpixels per square inch. As used herein, the term "unit subpixel area" in the context of the present disclosure refers to the area of an individual subpixel. Optionally, a number density of at least one of the first subpixel of a first color, the first subpixel of a second color, and the first subpixel of a third color is smaller than a number density of at least one of the second subpixel of the first color, the second subpixel of the second color, and the second subpixel of the third color. Optionally, a unit subpixel area of a subpixel of different color is different in either the first region or the second region. Optionally, a unit subpixel area of at least one of the first subpixel of a first color, the first subpixel of a second color, and the first subpixel of a third color is smaller than a unit subpixel area of at least one of the second subpixel of the first color, the second subpixel of the second color, and the second subpixel of the third color. Optionally, a number density of subpixels of a same color in the first region is smaller than a number density of subpixels of the same color in the second region. Optionally, a unit subpixel area of subpixels of a same color in the first region is smaller than a unit subpixel area of subpixels of the same color in the second region.

In another specific embodiment, the number density of at least a first one of the first subpixel of a first color, the first subpixel of a second color, and the first subpixel of a third color is smaller than a number density of at least a first one of the second subpixel of the first color, the second subpixel of the second color, and the second subpixel of the third color. The unit subpixel area of at least a second one of the first subpixel of a first color, the first subpixel of a second color, and the first subpixel of a third color is smaller than a unit subpixel area of at least a second one of the second subpixel of the first color, the second subpixel of the second color, and the second subpixel of the third color. The first one of the first subpixel of a first color, the first subpixel of a second color, and the first subpixel of a third color is different from the second one of the first subpixel of a first color, the first subpixel of a second color, and the first subpixel of a third color. The first one of the second subpixel of the first color, the second subpixel of the second color, and the second subpixel of the third color is different from the second one of the second subpixel of the first color, the second subpixel of the second color, and the second subpixel of the third color.

Yet, a luminance of each subpixel (such as a subpixel based on either a liquid crystal display layer or light-emitting diode layer) is proportional to its number density and its unit subpixel area. In yet another specific embodiment, the number density of at least the first subpixel of the second color is configured to be smaller than that of the second subpixel of the second color. The unit subpixel area of the first subpixel of the first color is configured to be smaller than that of the second subpixel of the first color. The unit subpixel area of the first subpixel of the third color is configured to be smaller than that of the second subpixel of the third color. The luminance ratio between the first subpixel of the first color and the first subpixel of the second color is substantially same as that between the second subpixel of the first color and the second subpixel of the second color. The luminance ratio between the first subpixel of the first color and the first subpixel of the third color is substantially same as that between the second subpixel of the first color and the second subpixel of the third color. As used herein, the term "substantially same" refers to a difference between two values not exceeding 10% of a base value (e.g., one of the two values), e.g., not exceeding 8%, not exceeding 6%, not exceeding 4%, not exceeding 2%, not exceeding 1%, not exceeding 0.5%, not exceeding 0.1%, not exceeding 0.05%, and not exceeding 0.01%, of the base value.

As the number density of subpixels of respective colors in the first pixel array is set to be smaller than the number density of subpixels of respective colors in the second pixel array, a smaller number of subpixels is placed in the first region than the second region, potentially allowing more open spaces between subpixels. Additionally, as the unit subpixel area of subpixels of respective colors in the first pixel array is set to be smaller than the unit subpixel area of subpixels of respective colors in the second pixel array, also providing more open spaces between subpixels. Collectively, based on either one or combined effect of reduction in number density and unit subpixel area, the first region 100 can be made with more open spaces between subpixels, yielding a higher transmission rate for sensing signals to pass through. In the embodiment, the hybrid regional subpixel layouts in both the first region 100 and the second region 200 are configured collectively to ensure a luminance ratio between the first subpixel of the first color and the first subpixel of the second color or the first subpixel of the third color substantially same as that between the second subpixel of the first color and the second subpixel of the second color or the second subpixel of the third color.

Many variations and modifications of the hybrid regional subpixel layouts can be arranged. For example, the number density of the first subpixel of the first color in the first region is set to be a first divide factor multiplying the number density of the second subpixel of the first color in the second region, and a unit subpixel area of a respective one first subpixel of the first color is set to be a second divide factor multiplying a unit subpixel area of a respective one second subpixel of the first color. Additionally, the number density of the first subpixel of the third color in the first region is set to be a third divide factor multiplying the number density of the second subpixel of the third color in the second region, and a unit subpixel area of a respective one first subpixel of the third color is set to be a fourth divide factor multiplying a unit subpixel area of a respective one second subpixel of the third color. A layout design constraint is set to keep a product of the third divide factor and the fourth divide factor to be equal to a product of the first divide factor and the second divide factor. Furthermore, the number density of the first subpixel of the second color in the first region is set to be a fifth divide factor multiplying the number density of the second subpixel of the second color in the second region, and a unit subpixel area of a respective one first subpixel of the second color is set to be a sixth divide factor multiplying a unit subpixel area of a respective one second subpixel of the second color. Again, a layout design constraint is set to keep a product of the fifth divide factor and the sixth divide factor to be equal to a product of the first divide factor and the second divide factor.

Optionally, each of the first divide factor, the second divide factor, the third divide factor, the fourth divide factor, the fifth divide factor, and the sixth divide factor is selected from a decimal number between 0 and 1.2.

Optionally, the first divide factor is in a range of 0.90 to 1.10 (e.g., 0.95 to 1.05, 0.99 to 1.01), the second divide factor is in a range of 0.40 to 0.60 (e.g., 0.45 to 0.55, 0.49 to 0.51), the third divide factor is 1, the fourth divide factor is in a range of 0.40 to 0.60 (e.g., 0.45 to 0.55, 0.49 to 0.51), the fifth divide factor is in a range of 0.40 to 0.60 (e.g., 0.45 to 0.55, 0.49 to 0.51), the sixth divide factor is in a range of 0.90 to 1.10 (e.g., 0.95 to 1.05, 0.99 to 1.01).

Optionally, a ratio of a width of a respective one of the first subpixels of the first/third color to a width of the respective one of the second subpixels of the first/third color is in a range of 0.40 to 0.60 (e.g., 0.45 to 0.55, 0.49 to 0.51), and a ratio of a length of the respective one of the first subpixels of the first/third color to a length of the respective one of the second subpixels of the first/third color is in a range of 0.90 to 1.10 (e.g., 0.95 to 1.05, 0.99 to 1.01).

Optionally, a ratio of a width of a respective one of the first subpixels of the first/third color to a width of the respective one of the second subpixels of the first/third color is in a range of 0.90 to 1.10 (e.g., 0.95 to 1.05, 0.99 to 1.01), and a ratio of a length of the respective one of the first subpixels of the first/third color to a length of the respective one of the second subpixels of the first/third color is in a range of 0.40 to 0.60 (e.g., 0.45 to 0.55, 0.49 to 0.51).

Optionally, the first pixel array includes a number density ratio of x:y:z for respective first subpixels of the first color, the second color, and the third color in the first region along both a row direction and a column direction of the first pixel array. Here x is in a range of 0.90 to 1.10 (e.g., 0.95 to 1.05, 0.99 to 1.01), y is in a range of 0.90 to 1.10 (e.g., 0.95 to 1.05, 0.99 to 1.01), and z is in a range of 0.90 to 1.10 (e.g., 0.95 to 1.05, 0.99 to 1.01).

Optionally, the second pixel array includes a number density ratio of m:n:k for respective second subpixels of the first color, the second color, and the third color in the second region along both a row direction and a column direction of the second pixel array. Here m is in a range of 0.90 to 1.10 (e.g., 0.95 to 1.05, 0.99 to 1.01), n is in a range of 1.90 to 2.10 (e.g., 1.95 to 2.05, 1.99 to 2.01), and k is in a range of 0.90 to 1.10 (e.g., 0.95 to 1.05, 0.99 to 1.01).

Figure 2A:
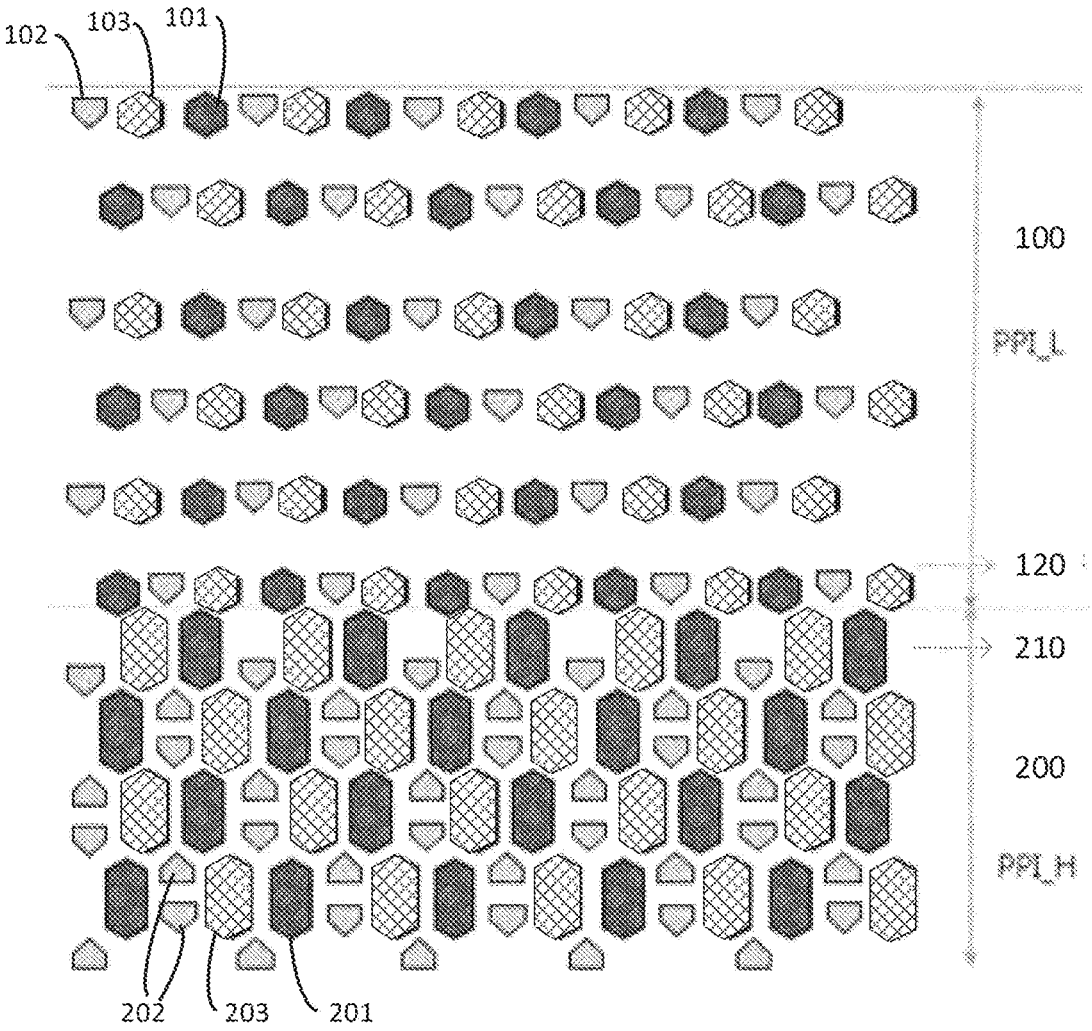
FIG. 2A is a schematic diagram of hybrid regional subpixel layouts across a first region and a second region for a full-panel display according to an embodiment of the present disclosure.
Figure 2B:
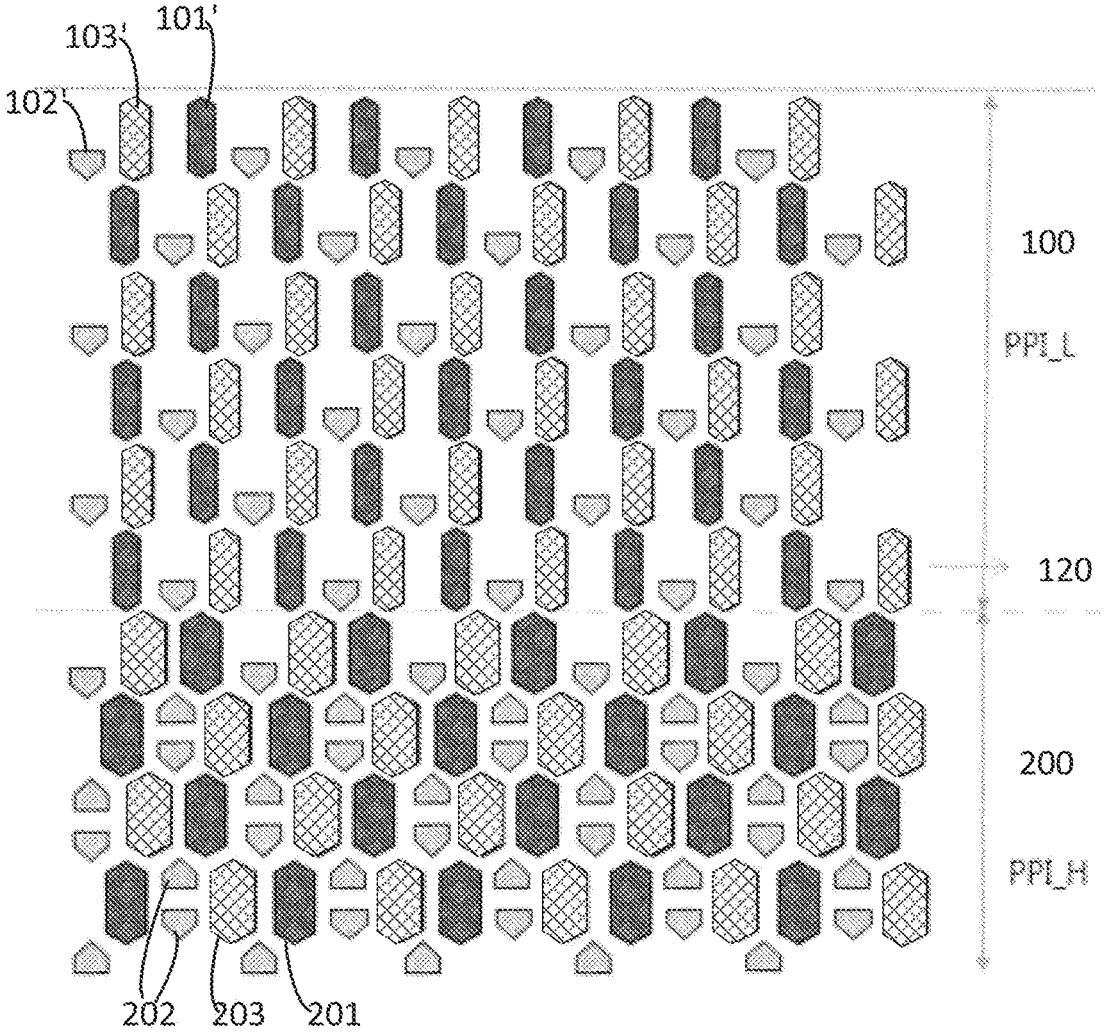
FIG. 2B is a schematic diagram of hybrid regional subpixel layouts across a first region and a second region for a full-panel display according to another embodiment of the present disclosure.

FIG. 2A shows an example of hybrid regional subpixel layouts across a first region and a second region of a full-panel display according to an embodiment of the present disclosure. FIG. 2B shows another example of the hybrid regional subpixel layouts across a first region and a second region of a full-panel display according to an embodiment of the present disclosure. The first region 100 in FIG. 2A and FIG. 2B is a transparent display region at least partially transparent to allow sensing signals to pass through a layer of a first pixel array with an enhanced transmission rate to reach at or to collect from one or more sensing accessory devices installed therein. The second region 200 in FIG. 2A and FIG. 2B is a normal display region.

Referring to FIG. 2A, the first pixel array in the first region 100 is distributed in a subpixel layout of at least a first subpixel of a first color 101, a first subpixel of a second color 102, and a first subpixel of a third color 103. Optionally, the first color is red color (R), the second color is green color (G), and the third color is blue color (B). Optionally, the pixel may include a first subpixel of a fourth color (not shown), or more. Optionally, the subpixel layout in the first region 100 is distributed as a real RGB diagonal arrangement per consecutive pair of odd-even rows. Each even row of subpixels is shifted in row direction by a distance of one and one half width of the first subpixel relative to each previous odd row of subpixels. This layout ensures that the first subpixels in the first region 100 are distributed uniformly along both the row direction and the column direction, facilitating for uniformly displaying an image. Similarly, the second pixel array in the second region 200 is distributed in a different subpixel layout of at least a second subpixel 201 of a first color, a second subpixel 202 of a second color, and a second subpixel 203 of a third color. Again, the first color is red color (R), the second color is green color (G), and the third color is blue color (B).

In the embodiment, referring to FIG. 2A, the second pixel array in the second region 200 is substantially same as a normal subpixel layout normally used in a normal display apparatus. For example, the second pixel array contains a GGRB subpixel layout. In the second region 200, each odd row of subpixels is arranged with a repeated pattern of one second subpixels of red color, two second subpixels of green color (in column direction), and one second subpixel of blue color. Each even row of subpixels has a similar pattern shifted in row direction by a distance of one and one half width of the second subpixel relative to each previous odd row of subpixels.

In the embodiment, referring to FIG. 2A, there is a pair of transition rows of subpixels at an interface region between the first region 100 and the second region 200. The pair of transitional rows of subpixels includes a first transitional row 120 belonging to the first region 100 and a second transitional row 210 belonging to the second region 200. The first transitional row 120 is comprised of a same repeated pattern as other rows in the first region 100. The second transitional row 210 is comprised of a repeat pattern of one second subpixel of the first color, one second subpixel of second color, and one second subpixel of third color with a lower number density of the second subpixel of the second color than that in the other rows in the second region 200.

Figure 5A:
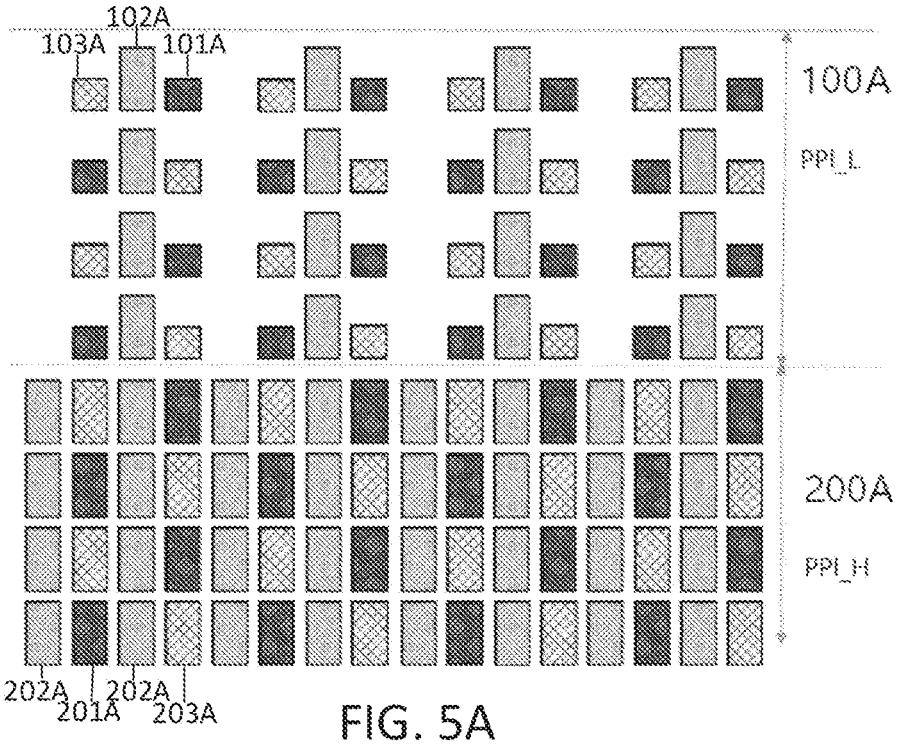
FIG. 5A is a schematic diagram of hybrid regional Strip RGBG subpixel layouts across a first region and a second region for a full-panel display according to another embodiment of the present disclosure.

Optionally, the subpixel layout in the second region 200A has a normal Strip RGBG pattern (see FIG. 5A). The subpixel layout in the first region 100A of the full-panel display includes a reduced number density but a same unit subpixel area for the first subpixel of the second color (G)

Figure 5B:
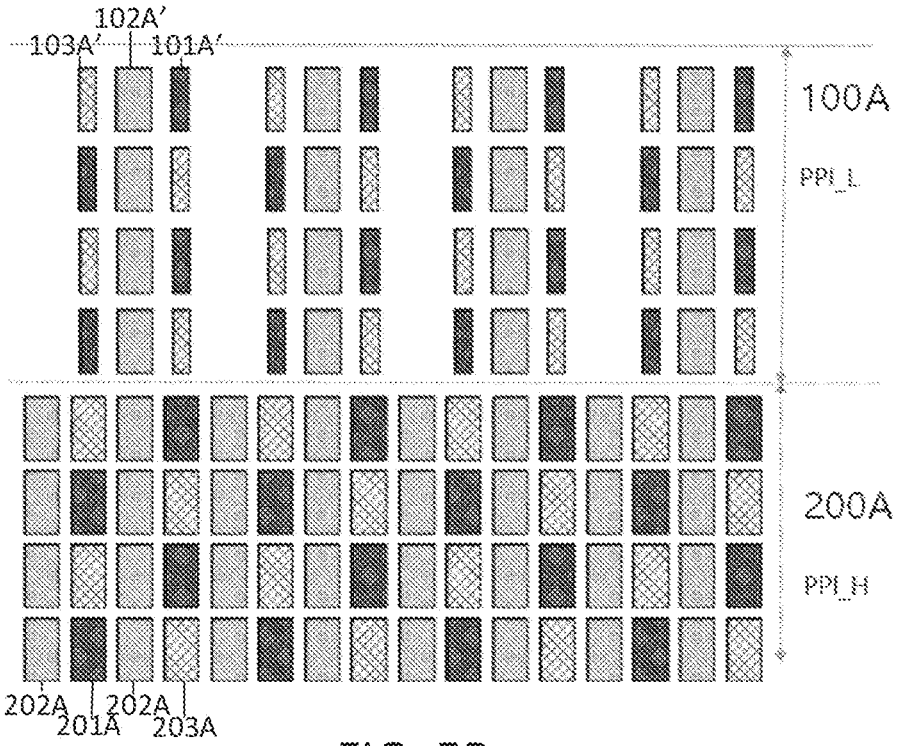
FIG. 5B is a schematic diagram of hybrid regional Strip RGBG subpixel layouts across a first region and a second region for a full-panel display according to another embodiment of the present disclosure.

102A compared with that of the second subpixel of green color 202A, and a reduced height but same number density for the first subpixel of the first color (R) 101A and the first subpixel of the third color (B) 103A compared with that of the second subpixel of red color 201A and the second subpixel of blue color 203A. Alternatively shown in FIG. 5B, the subpixel layout in the first region 100A includes a reduced number density but a same unit subpixel area for the first subpixel of the second color (G) 102A' compared with that of the second subpixel of green color 202A and a reduced width but a same number density for the first subpixel of the first color (R) 101A' and the first subpixel of the third color (B) 103A' compared with that of the second subpixel of red color 201A and the second subpixel of blue color 203A. A product of a number density and a unit subpixel area of a particular type of subpixel is proportional to a luminance of the type of subpixel. In the embodiment, a luminance ratio among the first subpixels of three different colors in the first region is kept the same as that among the second subpixels of three corresponding colors in the second region.

Figure 6A:
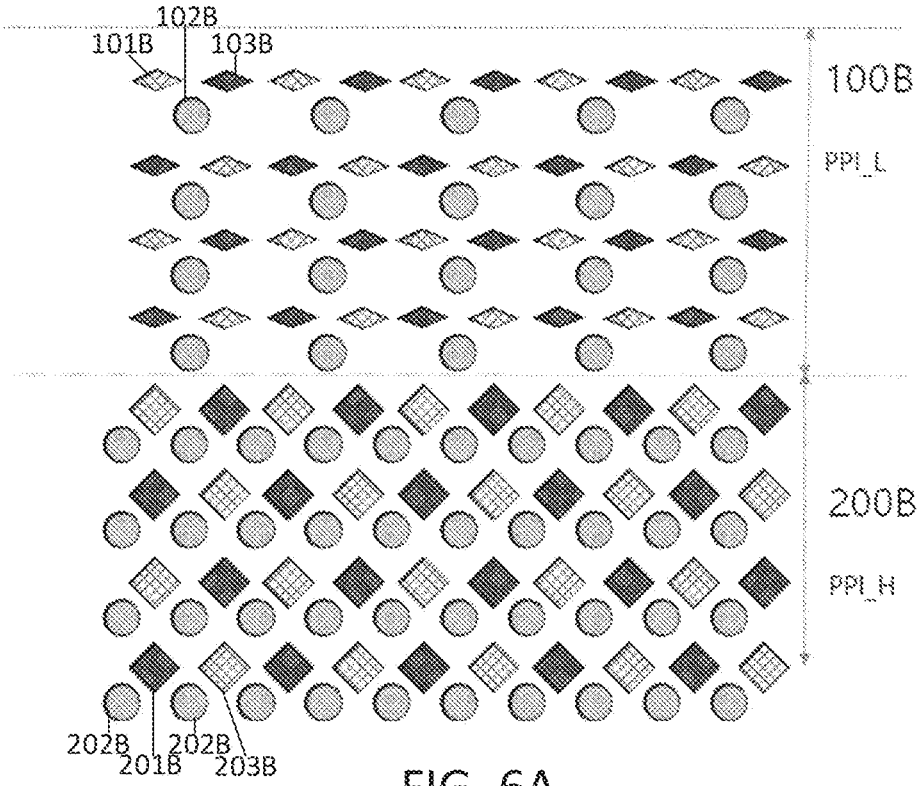
FIG. 6A is a schematic diagram of hybrid regional Diamond RGBG subpixel layouts across a first region and a second region for a full-panel display according to an embodiment of the present disclosure.
Figure 6B:
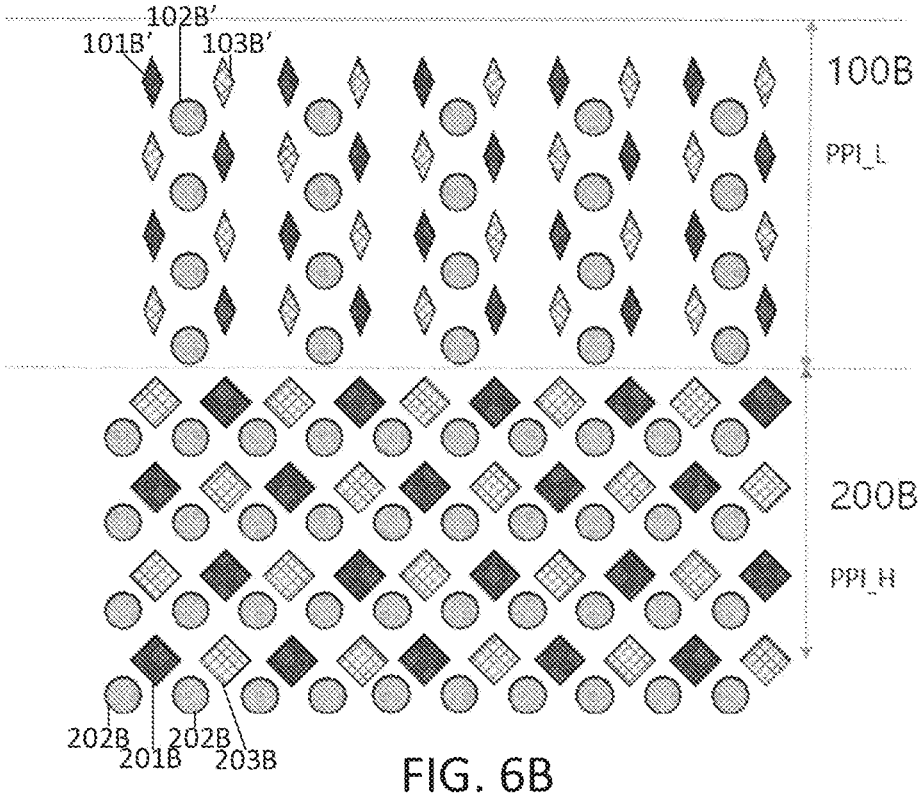
FIG. 6B is a schematic diagram of hybrid regional Diamond RGBG subpixel layouts across a first region and a second region for a full-panel display according to another embodiment of the present disclosure.

Optionally, the subpixel layout in the second region 200B has a Diamond RGBG pattern (see FIG. 6A). The subpixel layout in the first region 100B of the full-panel display includes a reduced number density but a same unit subpixel area for the first subpixel of the second color (G) 102B compared with that of the second subpixel of green color 202B, and a shrunk vertical dimension but a same number density for the first subpixel of the first color (R) 101B and the first subpixel of the third color (B) 103B in diamond shapes compared with that of the second subpixel of red color 201B and the second subpixel of blue color 203B in diamond shapes. Alternatively shown in FIG. 6B, the subpixel layout in the first region 100B includes a reduced number density but a same unit subpixel area for the first subpixel of the second color (G) 102B' compared with that of the second subpixel of green color 202B, and a shrunk lateral dimension but a same number density for the first subpixel of the first color (R) 101B' and the first subpixel of the third color (B) 103B' in diamond shapes compared with that of the second subpixel of red color 201B and the second subpixel of blue color 203B in diamond shapes. A product of a number density and a unit subpixel area of a particular type of subpixel is proportional to a luminance of the type of subpixel. In the embodiment, a luminance ratio among the first subpixels of three different colors in the first region is kept the same as that among the second subpixels of three corresponding colors in the second region.

Figure 7A:
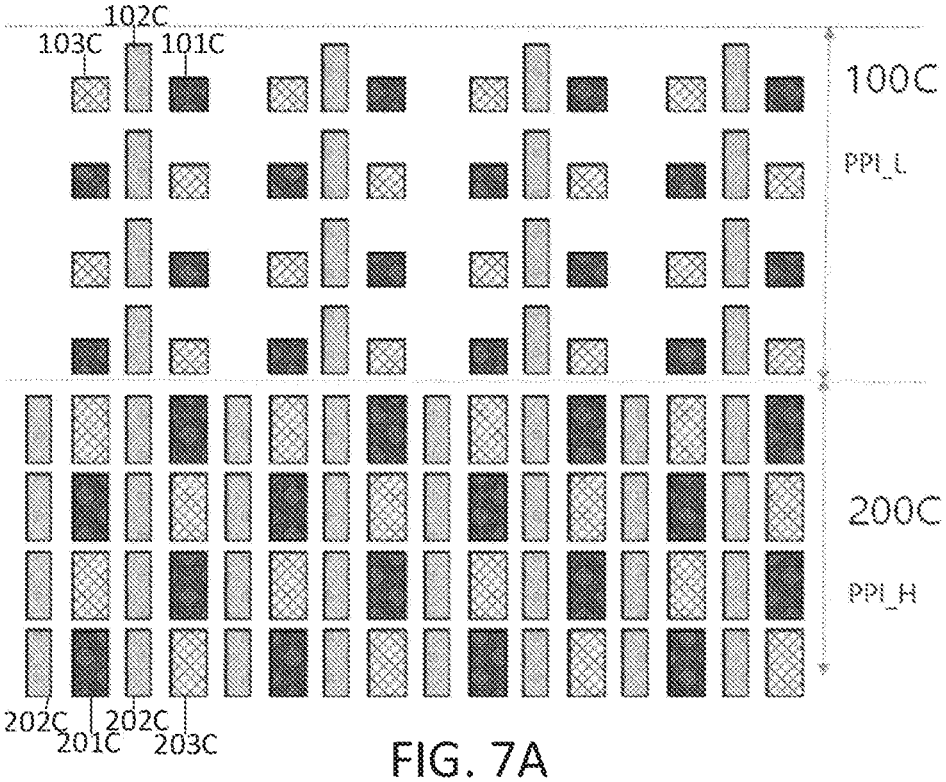
FIG. 7A is a schematic diagram of hybrid regional Pentile RGBG subpixel layouts across a first region and a second region for a full-panel display according to an embodiment of the present disclosure.
Figure 7B:
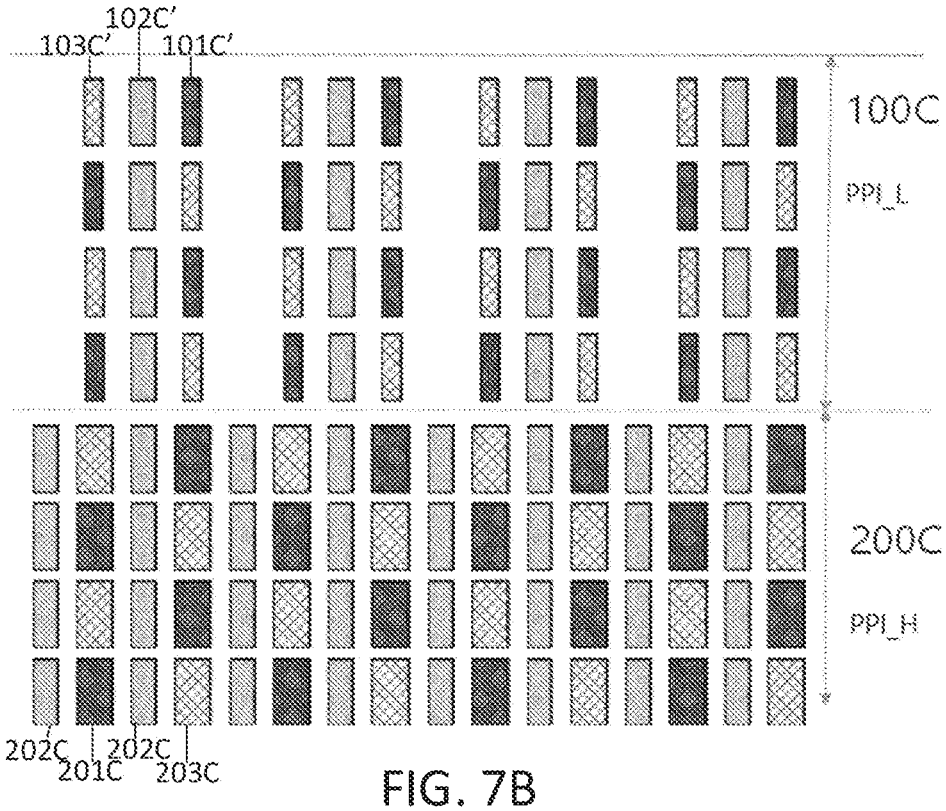
FIG. 7B is a schematic diagram of hybrid regional Pentile RGBG subpixel layouts across a first region and a second region for a full-panel display according to another embodiment of the present disclosure.

Optionally, the subpixel layout in the second region 200C has a Pentile RGBG pattern (see FIG. 7A), where the subpixels of red color (R) and the blue color (B) have a same unit subpixel area greater than that of the subpixel of green color (G) but a smaller number density than that of the subpixel of green color (G). The subpixel layout in the first region 100C of the full-panel display includes a reduced number density but a same unit subpixel area for the first subpixel of the second color (G) 102C compared with that of the second subpixel of green color 202C, and a reduced height but a same number density for the first subpixel of the first color (R) 101C and the first subpixel of the third color (B) 103C compared with that of the second subpixel of red color 201C and the second subpixel of blue color 203C. Alternatively shown in FIG. 7B, the subpixel layout in the first region 100C includes a reduced number density but a same unit subpixel area for the first subpixel of the second color (G) 102C' compared with that of the second subpixel of green color 202C and a reduced width but a same number density for the first subpixel of the first color (R) 101C' and the first subpixel of the third color (B) 103C' compared with that of the second subpixel of red color 201C and the second subpixel of blue color 203C. A product of a number density and a unit subpixel area of a particular type of subpixel is proportional to a luminance of the type of subpixel. In the embodiment, a luminance ratio among the first subpixels of three different colors in the first region is kept the same as that among the second subpixels of three corresponding colors in the second region.

In an embodiment, referring back to FIG. 2A, a first subpixel of red color 101 (first R subpixel) is configured with a shape having a rectangle sandwiched by two triangles respectively at its two ends with straight edges of the rectangle in parallel to the column (or vertical) direction. A maximum vertical span of the first R subpixel is defined as a distance along the column direction from one an apex point of a triangle at one end to another apex point of another triangle at another end. A maximum lateral span of the first R subpixel is defined as a distance along horizontal direction between two straight edges of the rectangle. Optionally, a first subpixel of blue color 103 (first B subpixel) is configured with a shape similar to that of the first R subpixel. Optionally, a first subpixel of green color 102 (first G subpixel) is configured with a shape obtained by cutting the shape of the first R subpixel in half along a middle line of the rectangle along horizontal or row direction. A maximum vertical span of the first G subpixel is defined a distance from a flat end to an apex point at the other end along the vertical direction. A maximum lateral span of the first G subpixel is defined the same as the distance between two straight edges of the rectangle which is cut in half along horizontal direction. Optionally, a second R or B subpixel in the second region 200 is similar in shape as that of the first R or B subpixel in the first region 100. In a specific embodiment, the maximum vertical span of a first R subpixel 101 and the maximum vertical span of the first B subpixel 103 in the first region 100 are about ½ of the maximum vertical span of the corresponding second R and B subpixels (201 and 203) in the second region 200, while their corresponding maximum lateral spans being substantially the same. Optionally, a second G subpixel in the second region 200 is substantially similar in shape as that of the first G subpixel in the first region 100. In the specific embodiment, the maximum vertical span and the maximum lateral span of the first G subpixel 102 are substantially same as the maximum vertical span and the maximum lateral span of the second G subpixel 202, respectively. In other words, a unit subpixel area of the first R subpixel 101 is set to be about ½ of a unit subpixel area of the second R subpixel 201, a unit subpixel area of the first B subpixel 103 is also set to be about ½ of that of the second B subpixel 203. Additionally, a unit subpixel area of the first G subpixel 102 is set to be substantially the same as a unit subpixel area of the second G subpixel 202.

In another specific embodiment, referring to FIG. 2B, a maximum lateral span of the first subpixel 101' of red color (first R subpixel) and a width of the first subpixel 103' of blue color (first B subpixel) in the first region 100 are about ½ of a maximum lateral span of the corresponding second subpixels (201 and 203) of respective colors in the second region 200, while their maximum vertical spans being substantially the same. A maximum vertical span and a maximum lateral span of the first subpixel 102' of green color (first G subpixel) are substantially same as a maximum lateral span and a maximum lateral span of the second subpixel 202 of green color. In other words, a unit subpixel area of the first R subpixel 101' is set to be about ½ of that of a unit subpixel area of the second R subpixel 201, a unit subpixel area of the first B subpixel 103' is also set to be about ½ of that of the second B subpixel 203. Additionally, a unit subpixel area of the first G subpixel 102' is set to be substantially the same as a unit subpixel area of the second G subpixel 202.

In another point of view, referring to both FIG. 2A and FIG. 2B, a number density ratio of the first subpixels of the R:G:B color is given as 1:1:1 and a number density ratio of the second subpixels of the R:G:B color is given as 1:2:1. The number density of the first G subpixel 102 (102') in the first region 100 is about ½ of the number density of the second G subpixel 202 in the second region 200. A lower number density of subpixels in the first region 100 corresponds to a lower value of pixel per inch PPI_L. A higher number density of subpixels in the second region 200 corresponds to a higher value of pixel per inch PPI_H. Because a luminance L of a subpixel is proportional to the number density and the unit subpixel area, the luminance ratio of different subpixels of respective colors (R, G, B) in the first region 100 is given by $L_{1R}:L_{1G}:L_{1B}$. The luminance ratio of different subpixels of respective colors (R, G, B) in the second region 200 is given by $L_{2R}:L_{2G}:L_{2B}$. In these examples, $L_{1R}:L_{1G}:L_{1B}=(½)L_{2R}:(½)L_{2G}:(½)L_{2B}=L_{2R}:L_{2G}:L_{2B}$. In general, the hybrid regional subpixel layouts are configured to reduce the number density and/or the unit subpixel area in the first region versus the second region while keeping the luminance ratio unchanged. The reduced the number density and/or the unit subpixel area enhances the transmission rate to the installed accessory devices in the first region while the unchanged luminance ratio maintains the first region (transparent display region) substantially free of color shift relative to the second region (normal display region).

Figure 4A:
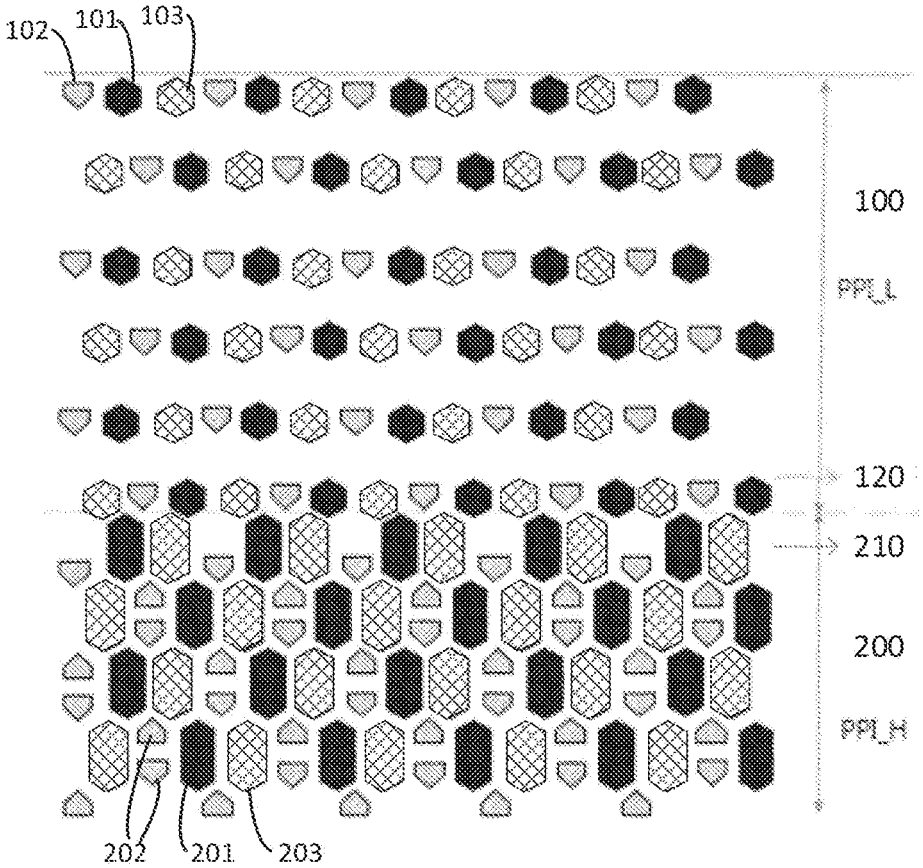
FIG. 4A is a schematic diagram of hybrid regional subpixel layouts across a first region and a second region for a full-panel display according to another embodiment of the present disclosure.
Figure 4B:
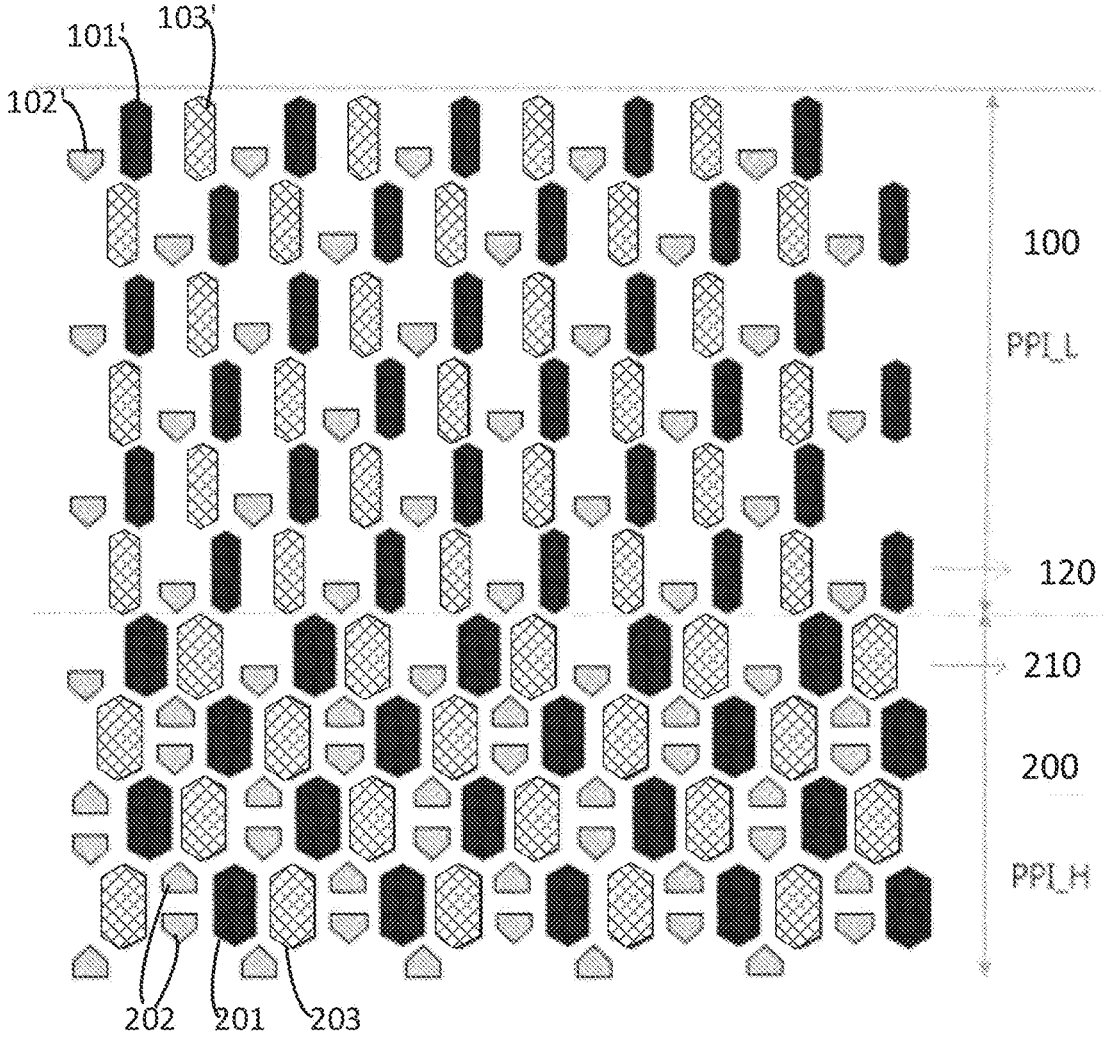
FIG. 4B is a schematic diagram of hybrid regional subpixel layouts across a first region and a second region for a full-panel display according to another embodiment of the present disclosure.

Optionally, the first R subpixel 101 and the first B subpixel 103 can exchange their positions in each row of subpixels in the first pixel array and the second R subpixel 201 and the second B subpixel 203 can exchange their positions in each row of subpixels in the second pixel array, as shown in FIG. 4A, comparing to FIG. 2A. Optionally, the first R subpixel 101' and the first B subpixel 103' can exchange their positions in each row of subpixels in the first pixel array and the second R subpixel 201 and the second B subpixel 203 can exchange their positions in each row of subpixels in the second pixel array, as shown in FIG. 4B, comparing to FIG. 2B. As long as the luminance ratio of subpixels in the first region is kept to be the substantially same as (for example, within proximately 10% error) that in the second region, $L_{1R}:L_{1G}:L_{1B}=L_{2R}:L_{2G}:L_{2B}$, the color shift across the interface between the first region and the second region will not be an issue for the full-panel display.

Figure 3:
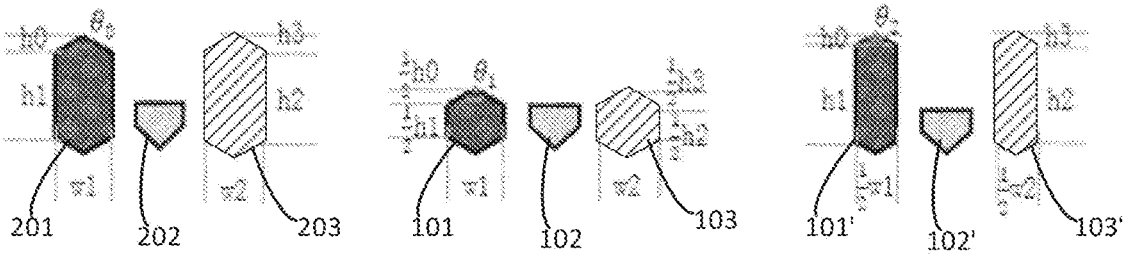
FIG. 3 is a schematic diagram of real subpixels of respective three colors in a normal display region in one embodiment and real subpixels of respective three colors in a transparent display region in two embodiments of the present disclosure.

FIG. 3 shows a schematic diagram of real subpixels of respective three colors (R, G, B) in a normal display region in one embodiment and real subpixels of respective three colors in a transparent display region in two embodiments of the present disclosure. Referring to FIG. 3, to the left part, the three real subpixels in a normal display region correspond respectively to a second subpixel of red color 201, a second subpixel of green color 202, and a second subpixel of blue color 203 (in the second region 200 of FIG. 2A) in a specific embodiment. The second subpixel of red color 201 is characterized by a width $w_1$, a main height $h_1$, an apex height $h_0$ at both top end and bottom end, and an apex angle $\theta_0$. The width $w_1$, as described earlier in FIG. 2A, is a maximum lateral span of the subpixel 201 between two straight edges. The main height $h_1$ is referred to the height of the rectangle part of the subpixel and apex height $h_0$ is the height of the triangle part in one end of the subpixel 201. A sum of $(h_1+2h_0)$ yields the maximum vertical span of the subpixel 201. The second subpixel of green color 202 is substantially smaller (or at least no greater) than half of the second subpixel of red color 201 with top end being flat. The second subpixel of blue color 203 is characterized, similarly to the second subpixel of red color 201, by a width $w_2$, a main height $h_2$, an apex height $h_3$ at both top end and bottom end, and an apex angle $\theta_0$. In this case, the width $w_2$ is the maximum lateral span of the subpixel 203. A sum, $(h_{2+}2h_3)$, is the maximum vertical span of the subpixel 203.

Referring to FIG. 3 again, in the middle part, the three real subpixels in a transparent display region correspond respectively to a first subpixel of red color 101, a first subpixel of green color 102, and a first subpixel of blue color 103 (as shown in the first region 100 of FIG. 2A) in a specific embodiment. The first subpixel of red color 101 is characterized by the same width $w_1$ as that of the second subpixel of red color 201, a half of the main height, $(½)h_1$, a half of the apex height, $(½)h_0$, at both top end and bottom end, and an apex angle $\theta_1$. In this case, the maximum lateral span of the subpixel 101 is $w_1$, the same as that of the subpixel 201, and the maximum vertical span is a sum of $(½)h_1$ and $h_0$, i.e., half of that of the subpixel 201. A unit area of the first subpixel of red color 101 is set to ½ of that of the second subpixel of red color 201. The first subpixel of green color 102 is substantially the same as the second subpixel of green color 202. The first subpixel of blue color 103 is characterized by the same width $w_2$ as that of the second subpixel of blue color 203, a half of the main height, $(½)h_2$, a half of the apex height, $(½)h_3$, at both top end and bottom end, and the apex angle $\theta_1$. The maximum lateral span of the subpixel 103 is $w_2$ which is the same as that of the subpixel 203 and the maximum vertical span is $(½)h_2+h_3$ which is half of that of the subpixel 203. A unit area of the first subpixel of blue color 103 is set to ½ of that of the second subpixel of blue color 203.

Referring to FIG. 3 again, to the right part, the three real subpixels in a transparent display region correspond respectively to a first subpixel of red color 101', a first subpixel of green color 102', and a first subpixel of blue color 103' (as shown in the first region 100 of FIG. 2B) in a specific embodiment. The first subpixel of red color 101' is characterized by a half of the width, $(½)w_1$, the same main height $h_1$ as that of the second subpixel of red color 201, the same apex height $h_0$ at both top end and bottom end, and an apex angle $\theta_2$. In this case, the maximum lateral span of the subpixel 101' is $(½)w_1$, i.e., half of that of the subpixel 201. The maximum vertical span of the subpixel 101' is $h_1+2h_0$, the same as that of the subpixel 201. A unit area of the first subpixel of red color 101' is set to ½ of that of the second subpixel of red color 201. The first subpixel of green color 102' is substantially the same as the second subpixel of green color 202. The first subpixel of blue color 103' is characterized by a half of the width, $(½)w_2$, the same main height $h_2$ as that of the second subpixel of blue color 203, the same apex height $h_3$ at both top end and bottom end, and the apex angle $\theta_2$. The maximum lateral span of the subpixel 103' is $(½)w_2$, i.e., half of that of the subpixel 203. The maximum vertical span of the subpixel 103' is, $h_2+2h_3$, the same as that of the subpixel 203. A unit area of the first subpixel of blue color 103' is set to ½ of that of the second subpixel of blue color 203. A relationship between the apex angle of end triangle and lateral dimension $w_1$ or vertical dimension $h_0$, respectively for the subpixels 201, 101, and 101' for these subpixels with the shape shown in FIG. 3 can be expressed by the following formulas:

$$\tan\left(\frac{\theta_0}{2}\right) = \frac{\frac{1}{2}w_1}{h_0} = \frac{w_1}{2h_0} \Rightarrow \theta_0 = 2\arctan\left(\frac{w_1}{2h_0}\right),$$

$$\tan\left(\frac{\theta_1}{2}\right) = \frac{\frac{1}{2}w_1}{\frac{1}{2}h_0} = 2 * \frac{w_1}{2h_0} = 2\tan\left(\frac{\theta_0}{2}\right) \Rightarrow \theta_1 = 2\arctan\left(2\tan\left(\frac{\theta_0}{2}\right)\right) = 2\arctan\left(\frac{w_1}{h_0}\right)$$

$$\tan\left(\frac{\theta_2}{2}\right) = \frac{\frac{1}{4}w_1}{h_0} = \frac{1}{2} * \frac{w_1}{2h_0} = \frac{1}{2}\tan\left(\frac{\theta_0}{2}\right) \Rightarrow \theta_2 = 2\arctan\left(\frac{1}{2}\tan\left(\frac{\theta_0}{2}\right)\right) = 2\arctan\left(\frac{w_1}{4h_0}\right).$$

Similarly the apex angle for respective subpixels 203, 103, and 103' can also derived from corresponding lateral dimension $w_2$ and vertical dimension $h_3$.

Smaller unit subpixel area allows the first region to have more open space between the neighboring first subpixels, raising the transmission rate for the sensing accessory devices installed below the first pixel array to sense the environmental signals. Optionally, the sensing accessory devices installed in the transparent display region include photosensors, fingerprint sensors, camera lens. Optionally, the accessory device installed in the transparent display region also includes an earpiece, a distance sensor, an infrared sensor, an acoustic sensor, an indicator, a button, a knob, or any combination thereof.

In another aspect, the present disclosure provides a display apparatus including a display panel having a first region and a second region respectively configured to form a full-panel display described herein. The full-panel display achieves substantially free of color shift but with a higher transmission rate in the first region with a first subpixel layout than that in the second region with a second subpixel layout for at least one accessory installed in the first region. Optionally, the display apparatus includes one or more driving integrated circuits connected to the display panel. Examples of appropriate display apparatuses include, but are not limited to, an electronic paper, a mobile phone, a tablet computer, a television, a monitor, a notebook computer, a digital album, a GPS, etc. Optionally, the display apparatus is a self-emitting display apparatus such as an organic light emitting diode display apparatus and a micro light emitting diode display apparatus.

Figure 9:
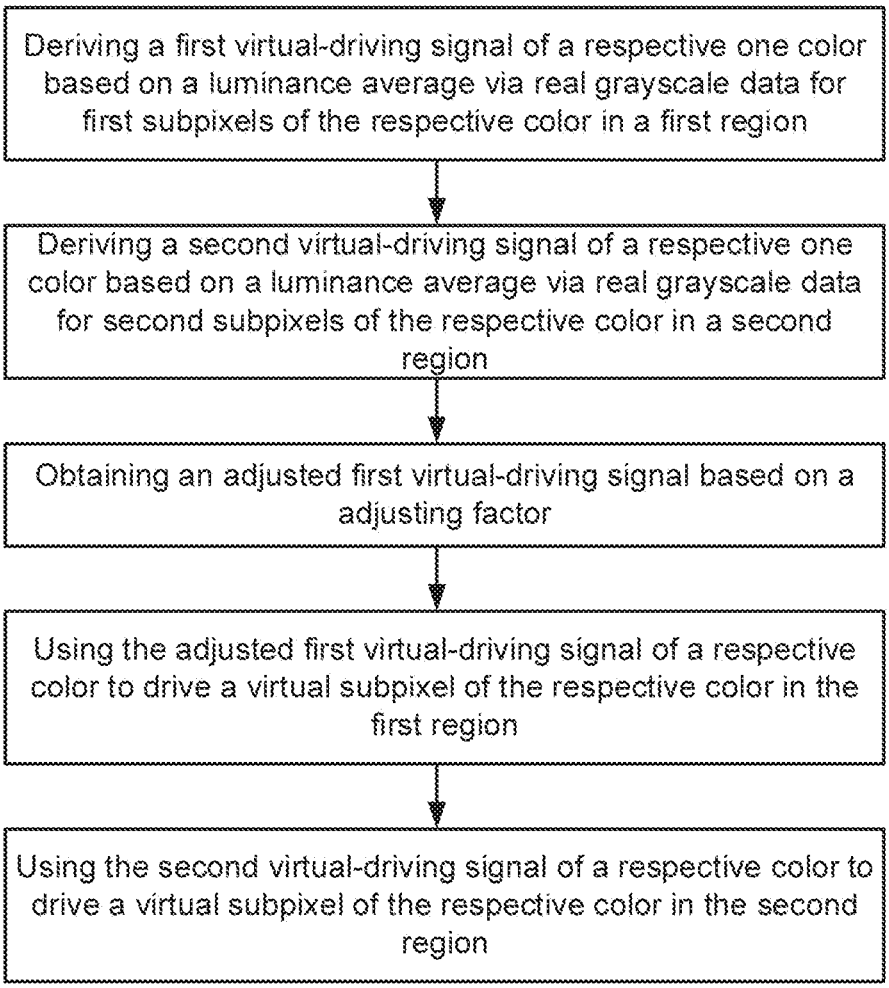
FIG. 9 shows a flow chart illustrating a method for driving a full-panel display with hybrid regional subpixel layouts according to some embodiments of the present disclosure.

In yet another aspect, the present disclosure provides a method of driving the full-panel display with hybrid regional subpixel layouts described herein. FIG. 9 shows a flow chart of the method of driving the full-panel display according to an embodiment of the present disclosure. In an embodiment, driving the image display through supplying real grayscale data to each real subpixel, such as subpixel of red color R, subpixel of green color G, subpixel of blue color B, can be achieved by using corresponding virtual-driving signals derived through a subpixel rendering (SPR) process based on the real grayscale data to drive respective virtual subpixels of respective colors.

Referring to FIG. 9, the method includes a step of deriving first virtual-driving signals of virtual subpixels of the first color, virtual subpixels of the second color, and virtual subpixels of the third color in the first region based on real grayscale data of the first subpixel of a first color, the first subpixel of a second color, and the first subpixel of a third color respectively loaded to first pixels in the first region. The method further includes a step of deriving second virtual-driving signals of virtual subpixels of the first color, virtual subpixels of the second color, and virtual subpixels of the third color in the second region based on real grayscale data of the second subpixel of a first color, the second subpixel of a second color, and the second subpixel of the third color respectively loaded to second pixels in the second region.

Additionally, the method includes a step of generating adjusted first virtual-driving signals for virtual subpixels in the first region by applying a grayscale adjusting factor to the first virtual-driving signals. Furthermore, the method includes a step of using the adjusted first virtual-driving signals to drive virtual subpixels in the first region to achieve an effective luminance of a unit area in the first region. Moreover, the method includes a step of using the second virtual-driving signals to drive virtual subpixels in the second region to achieve an effective luminance of a unit area in the second region. In this method, the grayscale adjusting factor is applied to render an effective luminance of a unit area in the first region to be substantially equal to effective luminance of a unit area in the second region based on same values of real grayscale data of the respective color. As used herein, the term "substantially equal to" refers to a difference between two values not exceeding 10% of a base value (e.g., one of the two values), e.g., not exceeding 8%, not exceeding 6%, not exceeding 4%, not exceeding 2%, not exceeding 1%, not exceeding 0.5%, not exceeding 0.1%, not exceeding 0.05%, and not exceeding 0.01%, of the base value.

The second region, in fact, is a normal display region that has a normal subpixel layout. Optionally, the step of deriving second virtual-driving signals can be executed in a first subpixel rendering (SPR1) process by using the formulas shown below.

$$R_i = \sqrt[Gamma]{\frac{r_i^{Gamma} + r_{i-1}^{Gamma}}{2}}$$

$$G_i = g_i$$

$$B_{i+1} = \sqrt[Gamma]{\frac{b_{i+1}^{Gamma} + b_i^{Gamma}}{2}}$$

$$G_{i+1} = g_{i+1}$$

Here, Gamma refers to a γ parameter applied during a Gamma correction of a subpixel luminance based on subpixel grayscale data.

In particular, for an array of virtual pixels arranged in RGBG subpixel arrangement in the second region, the SPR1 process includes deriving second virtual-driving signals includes deriving a second virtual-driving signal of a first color for an i-th virtual pixel in the second region as an effective grayscale data $R_i$ of the first color based on an average of a luminance of a second subpixel of the first color of an i-th second pixel in the second region generated by the respective real grayscale data $r_i$ thereof and a luminance of a second subpixel of the first color of a neighboring (i−1)-th second pixel in the second region generated by the respective real grayscale data $r_{i-1}$ thereof. Optionally, the first color is red (R). A luminance of a second subpixel of the first color of an i-th second pixel with a real grayscale data of $r_i$ can be expressed as a gamma-th power of the grayscale data, $r_i^{\gamma}$. The average of the luminance of a second subpixel of the first color of an i-th second pixel and the luminance of a second subpixel of the first color of an (i−1)-th second pixel is $(r_i^{\gamma}+r_{i-1}^{\gamma})/2$. The second virtual-driving signal $R_i$ for driving a virtual subpixel of red color thus is an effective grayscale data $R_i$ deduced from a gamma root of the average luminance, $[(r_i^{\gamma}+r_{i-1}^{\gamma})/2]^{1/\gamma}$, as a virtual subpixel of the first color is commonly shared in both the i-th second subpixel of first color and the (i−1)-th second subpixel of first color.

Additionally, the SPR1 process includes deriving a second virtual-driving signal of a second color for the i-th virtual pixel in the second region as an effective grayscale data $G_i$ of the second color substantially equal to the real grayscale data $g_i$ of the second color for the i-th second pixel in the second region. Optionally, the second color is green (G). $G_i=g_i$.

Furthermore, the SPR1 process includes deriving a second virtual-driving signal of a third color for a neighboring (i+1)-th virtual pixel in the second region as an effective grayscale data $B_{i+1}$ of the third color based on an average of a luminance of a second subpixel of the third color of the i-th second pixel in the second region generated by the respective real grayscale data b, thereof and a luminance of a second subpixel of the third color of a neighboring (i+1)-th second pixel in the second region generated by the respective real grayscale data $b_{i+1}$ thereof. Optionally, the third color is blue (B). $B_{i+1}=[(b_i^{\gamma}+b_{i+1}^{\gamma})/2]^{1/\gamma}$.

Moreover, the SPR1 process includes deriving a second virtual-driving signal of a second color for the neighboring (i+1)-th virtual pixel in the second region as an effective grayscale data of the second color substantially equal to the real grayscale data of the second color for the (i+1)-th second pixel in the second region. $G_{1+1}=g_{i+1}$.

Similarly, for an array of virtual pixels arranged in RGBG subpixel arrangement in the first region, the step of deriving first virtual-driving signals can be executed by running a second subpixel rendering (SPR2) calculations using the same formulas shown above. Optionally, the SPR2 process includes deriving a first virtual-driving signal of a first color for an i-th virtual pixel in the first region as an effective grayscale data R, of the first color based on an average of a luminance of a first subpixel of the first color of an i-th first pixel in the first region generated by the respective real grayscale data $r_i$ thereof and a luminance of a first subpixel of the first color of a neighboring (i−1)-th first pixel in the first region generated by the respective real grayscale data $r_{i-1}$ thereof, $[(r_i^{\gamma}+r_{i-1}^{\gamma})/2]^{\gamma/\gamma}$. The SPR2 process further includes deriving a first virtual-driving signal of a second color for the i-th virtual pixel in the first region as an effective grayscale data $G_i$ of the second color substantially equal to the real grayscale data $g_i$ of the second color for the i-th first pixel in the first region. Additionally, the SPR2 process includes deriving a first virtual-driving signal of a third color for a neighboring (i+1)-th virtual pixel in the first region as an effective grayscale data $B_{i+1}$ of the third color based on an average of a luminance of a first subpixel of the third color of the i-th first pixel in the first region generated by the respective real grayscale data $b_i$ thereof and a luminance of a first subpixel of the third color of a neighboring (i+1)-th first pixel in the first region generated by the respective real grayscale data $b_{i+1}$ thereof, $[(b_i^{\gamma}+b_{i+1}^{\gamma})/2]^{1/\gamma}$. Furthermore, the SPR2 process includes deriving a first virtual-driving signal of a second color for the neighboring (i+1)-th virtual pixel in the first region as an effective grayscale data $G_{i+1}$ of the second color substantially equal to the real grayscale data $g_{i+1}$ of the second color for the (i+1)-th first pixel in the first region.

Referring to descriptions for the full-panel display with hybrid regional subpixel layouts, the luminance of a unit area in the first region is smaller, i.e., ½, than that in the second region. In order to avoid causing non-uniform visual effect due to lower luminance in the first region than the second region, a grayscale adjusting factor k is generated and applied to render an effective luminance of a unit area in the first region to be substantially equal to effective luminance of a unit area in the second region based on same values of real grayscale data of the respective color. Therefore, the second subpixel rendering (SPR2) process further includes formulas shown below to generate adjusted first virtual-driving signals for driving virtual subpixels of respective colors, where the grayscale adjusting factor k is applied as a multiplication factor, i.e., $$R_i=k\times[(r_i^{\gamma}+r_{i-1}^{\gamma})/2]^{1/\gamma},$$

$$G_i=k\times g_i,$$

$$B_{i+1}=k\times[(b_i^{\gamma}+b_{i+1}^{\gamma})/2]^{1/\gamma}, \text{ and}$$

$$G_{i+1}=k\times g_{i+1}.$$

Figure 8:
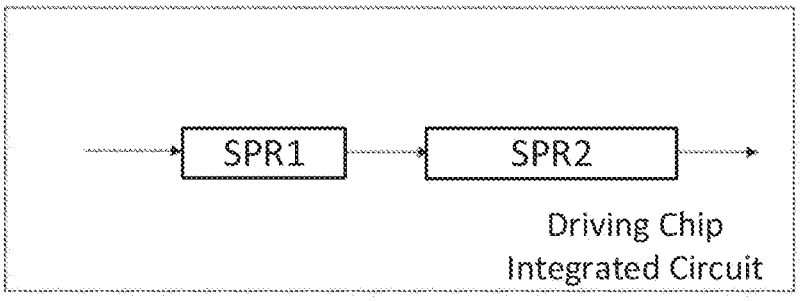
FIG. 8 is a schematic diagram of a driving chip integrated circuit comprising a two subpixel rendering processors respectively for a transparent display region and a normal display region according to an embodiment of the present disclosure.

Optionally, the method further includes another step of integrating the step of deriving a second virtual-driving signal for each virtual pixel in the second region into a first subpixel rendering processor (SPR1) in a driving chip's integrated circuit (IC), as shown in FIG. 8. Moreover, the method includes a step of integrating the step of deriving a first virtual-driving signal for each virtual pixel in the first region and the step of obtaining an adjusted first virtual-driving signal in the first region associated with the second region into a second subpixel rendering processor (SPR2) in the same driving chip IC (see FIG. 8). Here, the driving chip is configured to receive the real grayscale data (e.g., r, g, or b) for a respective subpixel of one respective color in the second region based on which the first subpixel rendering processor (SPR1) is used to perform a first rendering process to derive the corresponding second virtual-driving signals (R, G, or B). The driving chip is also configured to receive the real grayscale data for a respective subpixel of one respective color in the first region based on which the second subpixel rendering processor is used to perform a second rendering process to produce uniform luminance in a respective one virtual pixel in full panel including both the first region and the second region.

In another aspect, the present disclosure also provides a driving chip for driving a pixel arrangement structure having a plurality of subpixels. In some embodiments, the plurality of subpixels includes a first pixel array arranged in a first region and a second pixel array arranged in a second region. A respective first pixel comprises at least a first subpixel of a first color, a first subpixel of a second color, and a first subpixel of a third color. A respective second pixel comprises at least a second subpixel of the first color, a second subpixel of the second color, and a second subpixel of the third color. The first region has a higher transmission rate to an accessory installed therein and yet collectively to keep a luminance ratio between the first subpixel of the first color and the first subpixel of the second color or the first subpixel of the third color substantially same as that between the second subpixel of the first color and the second subpixel of the second color or the second subpixel of the third color. A number density or a unit subpixel area of at least one of the first subpixel of a first color, the first subpixel of a second color, and the first subpixel of a third color is smaller than a number density or a unit subpixel area of at least one of the second subpixel of the first color, the second subpixel of the second color, and the second subpixel of the third color.

In some embodiments, the driving chip includes a memory; and one or more processors. The memory and the one or more processors are connected with each other. In some embodiments, the memory stores computer-executable instructions for controlling the one or more processors to derive first virtual-driving signals of virtual subpixels of the first color, virtual subpixels of the second color, and virtual subpixels of the third color in the first region based on real grayscale data of the first subpixel of a first color, the first subpixel of a second color, and the first subpixel of a third color respectively loaded to first pixels in the first region; derive second virtual-driving signals of virtual subpixels of the first color, virtual subpixels of the second color, and virtual subpixels of the third color in the second region based on real grayscale data of the second subpixel of a first color, the second subpixel of a second color, and the second subpixel of the third color respectively loaded to second pixels in the second region; generate adjusted first virtual-driving signals for virtual subpixels in the first region by applying a grayscale adjusting factor to the first virtual-driving signals; use the adjusted first virtual-driving signals to drive virtual subpixels in the first region to achieve an effective luminance of a unit area in the first region; and use the second virtual-driving signals to drive virtual subpixels in the second region to achieve an effective luminance of a unit area in the second region. Optionally, the grayscale adjusting factor is applied to render an effective luminance of a unit area in the first region to be substantially equal to effective luminance of a unit area in the second region based on same values of real grayscale data of the respective color.

Various appropriate memory may be used in the present driving chip. Examples of appropriate memory include, but are not limited to, various types of processor-readable media such as random access memory (RAM), read-only memory (ROM), non-volatile random access memory (NVRAM), programmable read-only memory (PROM), erasable programmable read-only memory (EPROM), electrically erasable PROM (EEPROM), flash memory, magnetic or optical data storage, registers, magnetic disk or tape, optical storage media such as compact disk (CD) or DVD (digital versatile disk), and other non-transitory media. Optionally, the memory is a non-transitory memory. Various appropriate processors may be used in the present virtual image display apparatus. Examples of appropriate processors include, but are not limited to, a general-purpose processor, a central processing unit (CPU), a microprocessor, a digital signal processor (DSP), a controller, a microcontroller, a state machine, etc.

Various appropriate processors may be used in the present driving chip. Examples of processors include a central processing unit (CPU), a microprocessor unit (MPU), a microcontroller unit (MCU), an application-specific instruction set processor (ASIP), a graphics processing unit (GPU), physics processing unit (PPU), a digital system processor (DSP), a reduced instruction set (RISC) processor, an image processor, a coprocessor, a floating-point unit, a network processor, a multi-core processor, a front-end processor, a field-programmable gate array (FPGA), a video processing unit, a vision processing unit, a tensor processing unit (TPU), a neural processing unit (NPU), a system on a chip (SOC), and others.

Figure 10:
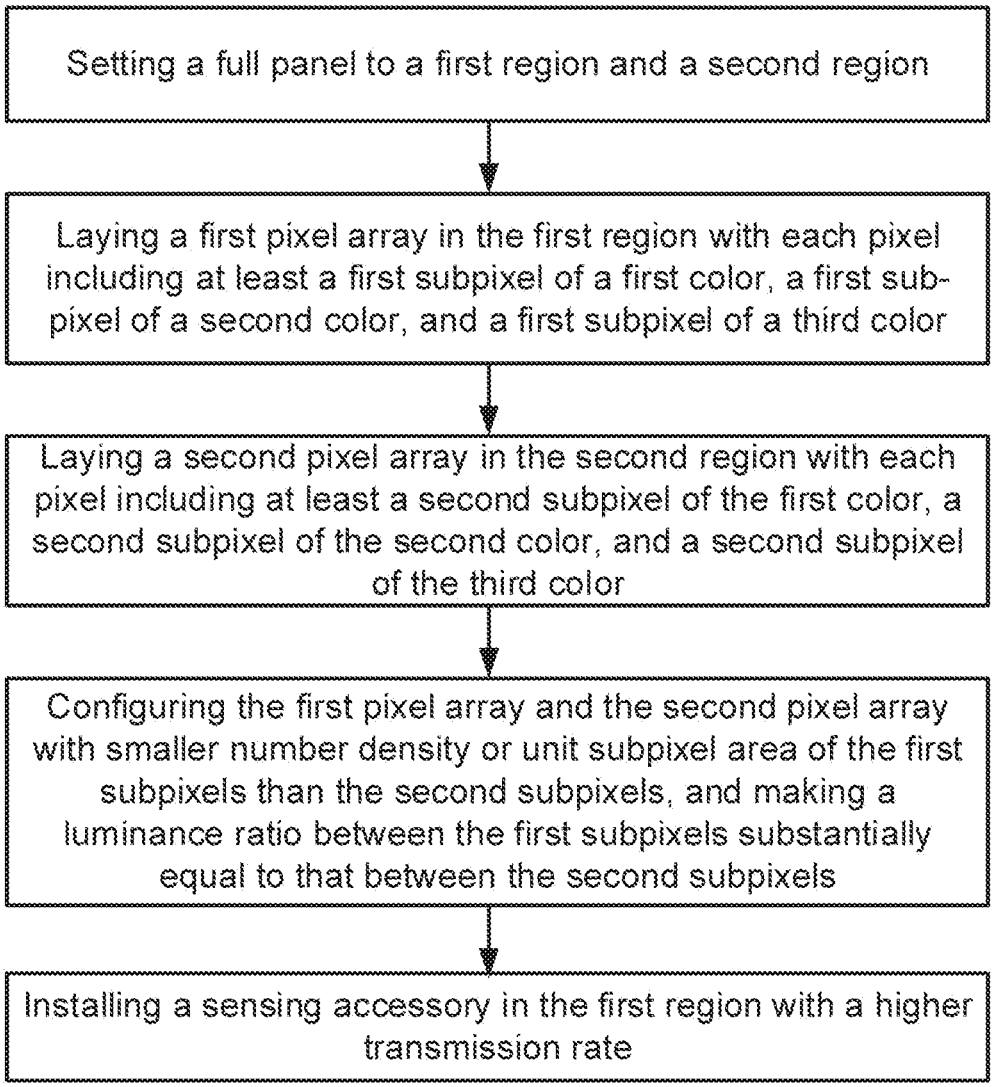
FIG. 10 shows a flow chart illustrating a method for forming a full-panel display according to some embodiments of the present disclosure.

In still another aspect, the present disclosure provides a method of forming a full-panel display. FIG. 10 shows a flow chart illustrating a method for forming a full-panel display according to some embodiments of the present disclosure. Referring to FIG. 10, the method includes a step of setting a full panel to a first region and a second region. The method further includes a step of laying a first pixel array in the first region. A respective first pixel includes at least a first subpixel of a first color, a first subpixel of a second color, and a first subpixel of a third color. Additionally, the method includes a step of laying a second pixel array in the second region. A respective second pixel includes at least a second subpixel of the first color, a second subpixel of the second color, and a second subpixel of the third color. Furthermore, the method includes configuring a number density or a unit subpixel area of at least one of the first subpixel of a first color, the first subpixel of a second color, and the first subpixel of a third color to be smaller than a number density or a unit subpixel area of at least one of the second subpixel of the first color, the second subpixel of the second color, and the second subpixel of the third color. Thereby, the step includes collectively making a luminance ratio between the first subpixel of the first color and the first subpixel of the second color or the first subpixel of the third color substantially same as that between the second subpixel of the first color and the second subpixel of the second color or the second subpixel of the third color. Moreover, the method includes installing a sensing accessory in the first region with a higher transmission rate for sensing signals through the first pixel array.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A full-panel display comprising:

a display panel with hybrid regional subpixel layouts having a first region and a second region;

a first pixel array arranged in the first region, a respective first pixel comprising a first subpixel of a first color, a first subpixel of a second color, and a first subpixel of a third color;

a second pixel array arranged in the second region, a respective second pixel comprising a second subpixel of the first color, a second subpixel of the second color, and a second subpixel of the third color;

wherein the first region has a higher transmission rate to an accessory installed therein and yet collectively to keep a ratio of luminance between the first subpixels of any two of the first color, the second color, and the third color substantially same as that between the second subpixels of corresponding two of the first color, the second color, and the third color;

a number density and/or a unit subpixel area of at least one of the first subpixel of the first color, the first subpixel of the second color, and the first subpixel of the third color is smaller than a number density and/or a unit subpixel area of at least one of the second subpixel of the first color, the second subpixel of the second color, and the second subpixel of the third color;

the number density of the first subpixel of the first color in the first region is set to be a first divide factor multiplying the number density of the second subpixel of the first color in the second region, and a unit subpixel area of a respective one first subpixel of the first color is set to be a second divide factor multiplying a unit subpixel area of a respective one second subpixel of the first color;

the number density of the first subpixel of the second color in the first region is set to be a fifth divide factor multiplying the number density of the second subpixel of the second color in the second region, and a unit subpixel area of a respective one first subpixel of the second color is set to be a sixth divide factor multiplying a unit subpixel area of a respective one second subpixel of the second color;

the number density of the first subpixel of the third color in the first region is set to be a third divide factor multiplying the number density of the second subpixel of the third color in the second region, and a unit subpixel area of a respective one first subpixel of the third color is set to be a fourth divide factor multiplying a unit subpixel area of a respective one second subpixel of the third color;

a product of the third divide factor and the fourth divide factor is substantially same as a product of the first divide factor and the second divide factor; and a product of the fifth divide factor and the sixth divide factor is substantially same as a product of the first divide factor and the second divide factor.

2. The full-panel display of claim 1, wherein the number density of at least a first one of the first subpixel of a first color, the first subpixel of a second color, and the first subpixel of a third color is smaller than a number density of at least a first one of the second subpixel of the first color, the second subpixel of the second color, and the second subpixel of the third color;

the unit subpixel area of at least a second one of the first subpixel of a first color, the first subpixel of a second color, and the first subpixel of a third color is smaller than a unit subpixel area of at least a second one of the second subpixel of the first color, the second subpixel of the second color, and the second subpixel of the third color;

the first one of the first subpixel of a first color, the first subpixel of a second color, and the first subpixel of a third color is different from the second one of the first subpixel of a first color, the first subpixel of a second color, and the first subpixel of a third color; and the first one of the second subpixel of the first color, the second subpixel of the second color, and the second subpixel of the third color is different from the second one of the second subpixel of the first color, the second subpixel of the second color, and the second subpixel of the third color.

3. The full-panel display of claim 1, wherein the number density of the first subpixel of the second color is configured to be smaller than that of the second subpixel of the second color;

the unit subpixel area of the first subpixel of the first color is configured to be smaller than that of the second subpixel of the first color;

the unit subpixel area of the first subpixel of the third color is configured to be smaller than that of the second subpixel of the third color;

the luminance ratio between the first subpixel of the first color and the first subpixel of the second color is substantially same as that between the second subpixel of the first color and the second subpixel of the second color; and the luminance ratio between the first subpixel of the first color and the first subpixel of the third color is substantially same as that between the second subpixel of the first color and the second subpixel of the third color.

4. The full-panel display of claim 1, wherein each of the first divide factor, the second divide factor, the third divide factor, the fourth divide factor, the fifth divide factor, and the sixth divide factor is selected from a number between 0 and 1.2.

5. The full-panel display of claim 1, wherein the first divide factor is in a range of 0.90 to 1.10, the second divide factor is in a range of 0.40 to 0.60, the third divide factor is 1, the fourth divide factor is in a range of 0.45 to 0.55, the fifth divide factor is in a range of 0.40 to 0.60, the sixth divide factor is in a range of 0.90 to 1.10.

6. The full-panel display of claim 5, wherein a ratio of a width of a respective one of the first subpixels of the first/third color to a width of the respective one of the second subpixels of the first/third color is in a range of 0.40 to 0.60, and a ratio of a length of the respective one of the first subpixels of the first/third color to a length of the respective one of the second subpixels of the first/third color is in a range of 0.90 to 1.10.

7. The full-panel display of claim 5, wherein a ratio of a width of a respective one of the first subpixels of the first/third color to a width of the respective one of the second subpixels of the first/third color is in a range of 0.90 to 1.10, and a ratio of a length of the respective one of the first subpixels of the first/third color to a length of the respective one of the second subpixels of the first/third color is in a range of 0.40 to 0.60.

8. The full-panel display of claim 1, wherein the first pixel array comprises a number density ratio of x:y:z for respective first subpixels of the first color, the second color, and the third color in the first region along both a row direction and a column direction, wherein x is in a range of 0.90 to 1.10, y is in a range of 0.90 to 1.10, and z is in a range of 0.90 to 1.10.

9. The full-panel display of claim 1, wherein the second pixel array comprises a number density ratio of m:n:k for respective second subpixels of the first color, the second color, and the third color in the second region along both a row direction and a column direction, wherein m is in a range of 0.90 to 1.10, n is in a range of 1.90 to 2.10, and k is in a range of 0.90 to 1.10.

10. The full-panel display of claim 1, comprising a pair of transitional rows of subpixels at an interface between the first region and the second region, the pair of transitional row of subpixels comprising a first row belonging to the first region with a substantially same repeated pattern as other rows in the first region and a second row belonging to the second region with a repeat pattern of one second subpixel of the second color, one second subpixel of third color, and one second subpixel of the first color and a number density for the second subpixel of the second color being lower than that in other rows in the second region.

11. The full-panel display of claim 1, wherein the first color is red color (R), the second color is green color (G), and the third color is blue color (B); wherein the first pixel array comprises a real RGB diagonal arrangement per consecutive pair of odd-even rows, wherein each even row of subpixels is shifted in row direction by a distance of one and one half width of the first subpixel relative to each previous odd row of subpixels.

12. The full-panel display of claim 1, wherein the first color is red color (R), the second color is green color (G), and the third color is blue color (B); wherein the second pixel array comprises a GGRB subpixel arrangement, wherein each odd row of subpixels comprises a repeat pattern of one second subpixels of red color, two second subpixels of green color in column direction, and one second subpixel of blue color, wherein each even row of subpixels is shifted in row direction by a distance of one and one half width of second subpixel relative to each previous odd row of subpixels.

13. The full-panel display of claim 12, wherein the number densities of respective second subpixels of red color, green color, and blue color in the second region comprises a ratio of 1:2:1 along both a row direction and a column direction.

14. The full-panel display of claim 1, wherein the first color is red color (R), the second color is green color (G), and the third color is blue color (B); wherein the second pixel array comprises a subpixel layout selected from one of a Pentile RGBG subpixel arrangement, a Strip RGBG subpixel arrangement, a Diamond RGBG subpixel arrangement in the second region.

15. A display apparatus comprising a display panel comprising a first region and a second region respectively configured to form a full-panel display of claim 1, the first region having a first plurality of first array subpixels and the second region having a second plurality of second array of subpixels, the full-panel display being substantially free of color shift but with a higher transmission rate in the first region than that in the second region for at least one accessory installed in the first region.

16. A method of driving a full-panel display including a display panel with hybrid regional subpixel layouts;

wherein the display panel has a first region and a second region;

a first pixel array is arranged in the first region, a respective first pixel comprising at least a first subpixel of a first color, a first subpixel of a second color, and a first subpixel of a third color;

a second pixel array is arranged in the second region, a respective second pixel comprising at least a second subpixel of the first color, a second subpixel of the second color, and a second subpixel of the third color;

wherein the first region has a higher transmission rate to an accessory installed therein and yet collectively to keep a ratio of luminance between the first subpixels of any two of the first color, the second color, and the third color substantially same as that between the second subpixels of corresponding two of the first color, the second color, and the third color;

a number density and/or a unit subpixel area of at least one of the first subpixel of the first color, the first subpixel of the second color, and the first subpixel of the third color is smaller than a number density and/or a unit subpixel area of at least one of the second subpixel of the first color, the second subpixel of the second color, and the second subpixel of the third color;

the number density of the first subpixel of the first color in the first region is set to be a first divide factor multiplying the number density of the second subpixel of the first color in the second region, and a unit subpixel area of a respective one first subpixel of the first color is set to be a second divide factor multiplying a unit subpixel area of a respective one second subpixel of the first color;

the number density of the first subpixel of the second color in the first region is set to be a fifth divide factor multiplying the number density of the second subpixel of the second color in the second region, and a unit subpixel area of a respective one first subpixel of the second color is set to be a sixth divide factor multiplying a unit subpixel area of a respective one second subpixel of the second color;

the number density of the first subpixel of the third color in the first region is set to be a third divide factor multiplying the number density of the second subpixel of the third color in the second region, and a unit subpixel area of a respective one first subpixel of the third color is set to be a fourth divide factor multiplying a unit subpixel area of a respective one second subpixel of the third color;

a product of the third divide factor and the fourth divide factor is substantially same as a product of the first divide factor and the second divide factor; and a product of the fifth divide factor and the sixth divide factor is substantially same as a product of the first divide factor and the second divide factor;

the method comprising:

deriving first virtual-driving signals of virtual subpixels of the first color, virtual subpixels of the second color, and virtual subpixels of the third color in the first region based on real grayscale data of the first subpixel of the first color, the first subpixel of the second color, and the first subpixel of the third color respectively loaded to first pixels in the first region;

deriving second virtual-driving signals of virtual subpixels of the first color, virtual subpixels of the second color, and virtual subpixels of the third color in the second region based on real grayscale data of the second subpixel of the first color, the second subpixel of the second color, and the second subpixel of the third color respectively loaded to second pixels in the second region;

generating adjusted first virtual-driving signals for virtual subpixels in the first region by applying a grayscale adjusting factor to the first virtual-driving signals;

using the adjusted first virtual-driving signals to drive virtual subpixels in the first region to achieve an effective luminance of a unit area in the first region; and using the second virtual-driving signals to drive virtual subpixels in the second region to achieve an effective luminance of a unit area in the second region;

wherein the grayscale adjusting factor is applied to render an effective luminance of a unit area in the first region to be substantially equal to effective luminance of a unit area in the second region based on same values of real grayscale data of the respective color.

17. A driving chip for driving a pixel arrangement structure having a plurality of subpixels;

wherein the plurality of subpixels comprise a first pixel array arranged in a first region and a second pixel array arranged in a second region;

a respective first pixel comprises at least a first subpixel of a first color, a first subpixel of a second color, and a first subpixel of a third color;

a respective second pixel comprises at least a second subpixel of the first color, a second subpixel of the second color, and a second subpixel of the third color;

wherein the first region has a higher transmission rate to an accessory installed therein and yet collectively to keep a ratio of luminance between the first subpixels of any two of the first color, the second color, and the third color substantially same as that between the second subpixels of corresponding two of the first color, the second color, and the third color;

a number density and/or a unit subpixel area of at least one of the first subpixel of the first color, the first subpixel of the second color, and the first subpixel of the third color is smaller than a number density and/or a unit subpixel area of at least one of the second subpixel of the first color, the second subpixel of the second color, and the second subpixel of the third color;

the number density of the first subpixel of the first color in the first region is set to be a first divide factor multiplying the number density of the second subpixel of the first color in the second region, and a unit subpixel area of a respective one first subpixel of the first color is set to be a second divide factor multiplying a unit subpixel area of a respective one second subpixel of the first color;

the number density of the first subpixel of the second color in the first region is set to be a fifth divide factor multiplying the number density of the second subpixel of the second color in the second region, and a unit subpixel area of a respective one first subpixel of the second color is set to be a sixth divide factor multiplying a unit subpixel area of a respective one second subpixel of the second color;

the number density of the first subpixel of the third color in the first region is set to be a third divide factor multiplying the number density of the second subpixel of the third color in the second region, and a unit subpixel area of a respective one first subpixel of the third color is set to be a fourth divide factor multiplying a unit subpixel area of a respective one second subpixel of the third color;

a product of the third divide factor and the fourth divide factor is substantially same as a product of the first divide factor and the second divide factor; and a product of the fifth divide factor and the sixth divide factor is substantially same as a product of the first divide factor and the second divide factor;

wherein the driving chip comprises:

a memory;

one or more processors;

wherein the memory and the one or more processors are connected with each other; and the memory stores computer-executable instructions for controlling the one or more processors to:

derive first virtual-driving signals of virtual subpixels of the first color, virtual subpixels of the second color, and virtual subpixels of the third color in the first region based on real grayscale data of the first subpixel of the first color, the first subpixel of the second color, and the first subpixel of the third color respectively loaded to first pixels in the first region;

derive second virtual-driving signals of virtual subpixels of the first color, virtual subpixels of the second color, and virtual subpixels of the third color in the second region based on real grayscale data of the second subpixel of the first color, the second subpixel of the second color, and the second subpixel of the third color respectively loaded to second pixels in the second region;

generate adjusted first virtual-driving signals for virtual subpixels in the first region by applying a grayscale adjusting factor to the first virtual-driving signals;

use the adjusted first virtual-driving signals to drive virtual subpixels in the first region to achieve an effective luminance of a unit area in the first region; and use the second virtual-driving signals to drive virtual subpixels in the second region to achieve an effective luminance of a unit area in the second region;

wherein the grayscale adjusting factor is applied to render an effective luminance of a unit area in the first region to be substantially equal to effective luminance of a unit area in the second region based on same values of real grayscale data of the respective color.

* * * * *